US007063223B2

(12) United States Patent
Iwahara et al.

(10) Patent No.: US 7,063,223 B2
(45) Date of Patent: Jun. 20, 2006

(54) FOLDING CONTAINER

(75) Inventors: Kunihiko Iwahara, Gifu (JP); Kazuhiko Miyata, Gifu (JP)

(73) Assignee: Sanko Co., LTD, Gifu (JP)

( * ) Notice: Subject to any disclaimer, the term of this patent is extended or adjusted under 35 U.S.C. 154(b) by 152 days.

(21) Appl. No.: 10/013,705

(22) Filed: Dec. 13, 2001

(65) Prior Publication Data

US 2002/0092850 A1 Jul. 18, 2002

(30) Foreign Application Priority Data

Jan. 17, 2001 (JP) ..... 2001-008443
Nov. 26, 2001 (JP) ..... 2001-359060
Nov. 26, 2001 (JP) ..... 2001-359062

(51) Int. Cl.
*B65D 8/14* (2006.01)

(52) U.S. Cl. ..... 220/6; 220/7

(58) Field of Classification Search ..... 220/6, 220/7, 4.28, 831; 229/178, 125; 206/600, 206/509; 217/8, 65, 38, 47, 14, 15; 292/102
See application file for complete search history.

(56) References Cited

U.S. PATENT DOCUMENTS 516,246 A * 3/1894 Turck ..... 229/178
611,836 A * 10/1898 Cunningham ..... 217/15
927,485 A * 7/1909 Brown ..... 229/178
1,001,051 A * 8/1911 Kohout ..... 220/6
1,102,445 A * 7/1914 Schwab ..... 229/125.08
1,176,683 A * 3/1916 McPherson et al. ... 229/117.05
1,574,396 A * 2/1926 Hoy ..... 229/125.19
2,731,191 A * 1/1956 Layne ..... 229/117.17
3,130,850 A * 4/1964 Oakley et al. ..... 220/6
3,937,390 A * 2/1976 Winkler ..... 229/119
4,014,458 A * 3/1977 Berges ..... 220/826
4,037,777 A * 7/1977 Maughan ..... 229/117.17
4,062,467 A * 12/1977 Friedrich ..... 220/7
D271,343 S * 11/1983 Miller ..... D3/294
4,620,644 A * 11/1986 Miller ..... 220/826
4,693,386 A * 9/1987 Hughes et al. ..... 220/1.5
4,735,331 A * 4/1988 Keenan et al. ..... 220/6
5,161,709 A * 11/1992 Oestreich, Jr. ..... 220/6
5,199,592 A * 4/1993 Reiland et al. ..... 220/817
5,228,617 A * 7/1993 McGrath ..... 229/127
5,328,090 A * 7/1994 Hanlon ..... 229/171
5,474,197 A * 12/1995 Hillis et al. ..... 220/6
5,535,942 A * 7/1996 Vilona ..... 229/199
5,562,246 A * 10/1996 Smith et al. ..... 229/117.16
5,860,590 A * 1/1999 Blomfield et al. ..... 229/165
5,865,334 A * 2/1999 Ruiz et al. ..... 220/6
5,938,059 A * 8/1999 Luburic ..... 220/6

FOREIGN PATENT DOCUMENTS

FR 2762300 * 10/1998

* cited by examiner

*Primary Examiner*—Joseph C. Merek
(74) *Attorney, Agent, or Firm*—Westerman, Hattori, Daniels & Adrian, LLP

(57) ABSTRACT

In a folding container assembled in a box form by raising folded long side walls 51 so as to stand perpendicular to a bottom portion 10 and then raising folded short side walls 27 so as to stand perpendicular to the bottom portion, each of the short side walls is composed of an upper short side wall portion 27*a* and a lower short side wall portion 27*b*, and horizontal pins h3 formed on the upper short side wall portion are inserted into corresponding slits 35 in hinge female blocks H3formed on the lower short side wall portion to hinge the upper short side wall portion and the lower short side wall portion together. The short side walls are each composed of the upper short side wall portion and lower short side wall portion connected together with hinge members to reduce the height of the folded folding container. Accordingly, the folded folding container can be more efficiently housed to save housing spaces.

2 Claims, 30 Drawing Sheets

FOLDING CONTAINER

FIELD OF THE INVENTION

The present invention relates to a folding container in which side walls disposed so as to surround a bottom portion are folded so as to overlap the bottom portion.

BACKGROUND OF THE INVENTION

As shown in FIGS. 28 to 30, a folding container has been known which is composed of long side walls 2 connected to opposite long sides 1*a* of a rectangular bottom portion 1 with appropriate hinges and short side walls 3 similarly connected to opposite short sides 1*b* of the bottom portion 1 with appropriate hinges. In a folded state, the short side walls 3 are folded so as to overlap the bottom portion 1, and the long side walls 2 are further folded thereon, as shown in FIG. 30. Then, the folded long side walls 2 are raised so as to stand perpendicular to the bottom portion 1 as shown in FIG. 29, and the folded short side walls 3 are raised so as to stand perpendicular to the bottom portion 1, thereby obtaining an assembled box-shaped container as shown in FIG. 28. Then, engaging pieces 3*a* formed on each of the perpendicular ends of each short side wall 3 are engaged with engaging recesses 2*a* formed on each of the perpendicular ends of each long side wall 2 so that the short side walls 3 of the folding container assembled in a box form will not fall down easily.

The above described conventional folding container is still high even after it has been folded as shown in FIG. 30. Accordingly, it cannot be efficiently housed even after folding, resulting in the need for a large housing space.

As shown in FIG. 28, when the folding container is assembled in a box form, if the engaging pieces 3*a* of the short side walls 3 are weakly engaged with the corresponding engaging recesses 2*a* of the long side walls 2, then disadvantageously they may be easily disengaged from each other. Consequently, the short side walls 3 of the folding container assembled in a box form may fall inwardly.

Further, if the engaging pieces 3*a* of the short side walls 3 are strongly engaged with the corresponding engaging recesses 2*a* of the long side walls 2, when the short side walls 3 are brought down onto the bottom portion 1 as shown in FIG. 29, the engaging pieces 3*a* of the short side walls 3 are not easily removed from the corresponding engaging recesses 2*a* of the long side walls 2, hindering the folding container from being smoothly folded. Furthermore, when the short side walls 3 placed on the bottom portion 1 are raised to assemble the container in a box form, the engaging pieces 3*a* of the short side walls 3 are not easily engaged with the corresponding engaging recesses 2*a* of the long side walls 2, hindering the folding container from being smoothly assembled in a box form.

It is an object of the present invention to solve the above described problems of the conventional folding container.

SUMMARY OF THE INVENTION

To attain the above object, the present invention provides a folding container assembled in a box form by raising folded long side walls to stand perpendicular to a bottom portion and then raising folded short side walls to stand perpendicular to the bottom portion, wherein, first, the short side walls are each composed of an upper short side wall portion and a lower short side wall portion which are connected together via hinge members. Second, the upper short side wall portion placed on the lower short side wall portion is locked on the lower short side portion by lock means. Third, the lock means is composed of fitting slots formed in the lower short side wall portion and engagingly-locking protruding pieces formed on the upper short side wall portion and which are fitted in the corresponding fitting slots. Fourth, the long side wall and the short side wall are engaged with each other by inserting fitting protruding pieces formed on the lower short side wall portion into corresponding through-slots in fitting pieces formed on the long side wall. Fifth, inserting protruding pieces are each formed close to a corresponding one of opposite perpendicular edges of the upper short side wall portion, and are each inserted into a clearance formed between a corresponding inner frame of the fitting piece protrusively formed on the long side wall and the corresponding fitting protruding piece formed on the lower short side wall portion and which has been inserted into the through-slot drilled in the fitting piece. Sixth, the upper short side wall portion and lower short side portion constituting the short side wall are placed on the bottom portion so as to be flush therewith. Seventh, inward-fall preventing protrusions are formed at an upper end of the lower short side wall portion, and similar inward-fall preventing protrusions are danglingly formed at a lower end of the upper short side wall portion so that when the upper short side wall portions of the folding container assembled in a box form are rotationally moved substantially through 180° from a state in which the lower short side wall portion and the upper short side wall portion are placed on each other until the lower short side wall portion and the upper short side wall portion are substantially flush with each other, the inward-fall preventing protrusions formed at the lower end of the upper short side wall portion impact the corresponding inward-fall preventing protrusions protrusively formed at the upper end of the lower short side wall portion, thereby preventing the upper short side wall portion from rotatably moving inwardly of the folding container from a perpendicular state thereof. Eighth, in a folding container assembled in a box form by raising folded long side walls to stand perpendicular to a bottom portion and then raising folded short side walls to stand perpendicular to the bottom portion, short side walls are each composed of an upper short side wall portion and a lower short side wall portion which are hinged together, and when folding containers are stacked together, protrusions formed on the long side wall of a folding container assembled in a box form and located below are inserted into corresponding long-side fitted recesses formed on a long side of the bottom portion of a folding container assembled in a box form and located above. Ninth, in a folding container assembled in a box form by raising folded long side walls to stand perpendicular to a bottom portion and then raising folded short side walls to stand perpendicular to the bottom portion, short side walls are each composed of an upper short side wall portion and a lower short side wall portion which are hinged together, and when folding containers are stacked together, projections protrusively formed on hinge male blocks formed on the lower short side wall portion of a folding container assembled in a box form and located below are inserted into corresponding short-side fitted recesses formed on a short side of the bottom portion of a folding container assembled in a box form and located above.

DETAILED DESCRIPTION OF THE PREFERRED EMBODIMENTS

Figure 1:
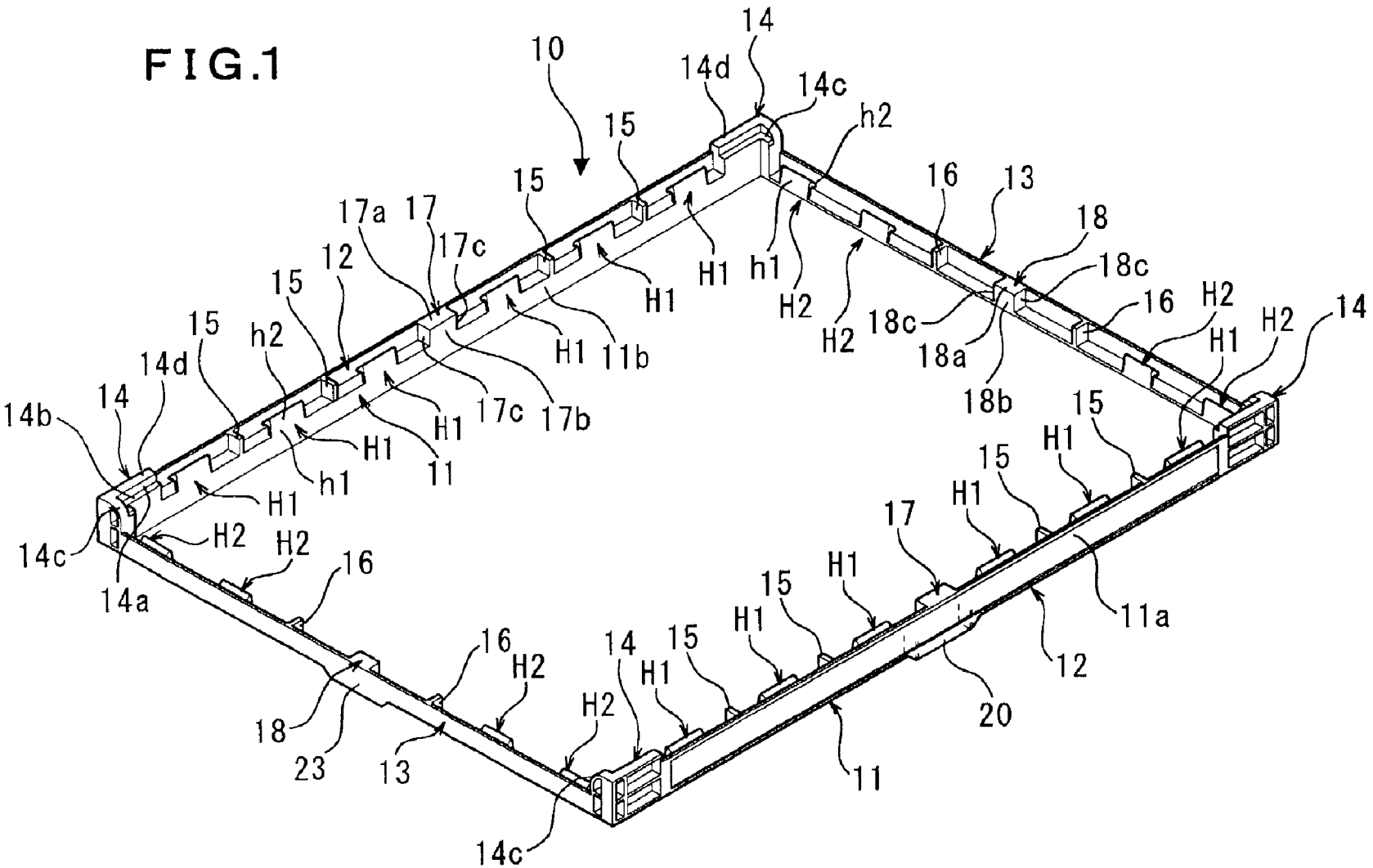
FIG. 1 is a perspective view of a bottom portion of a folding container according to the present invention.

Embodiments of the present invention will be described below, but the present invention is not limited to these embodiments as long as the spirits thereof are maintained.

First, a bottom portion 10 integrally molded of a synthetic resin will be described with reference to FIGS. 1 to 4.

The bottom portion 10 is generally shaped like a rectangle as viewed in plan, and has a long-side shoulder portion 11 formed on each of the opposite long sides thereof and having a generally inversely U-shaped cross section that is perpendicular to a longitudinal direction thereof. The long-side shoulder portion 11 has an outer wall (hereinafter referred to as a "long-side outer wall") 12 formed on an outer top surface thereof and which is flush with an outer wall 11*a* of the long-side shoulder portion 11 and which extends upward. Further, the long-side shoulder portion 11 has plate-shaped potions h1 formed on an inner top surface thereof so as to constitute long-side hinge female portions H1 and extending upward, and hooks h2 each formed on the corresponding plate-shaped portion h1 and having a tip bent toward the long-side outer wall 12. The long-side shoulder portion 11 has an appropriate number of long-side hinge female portions H1 formed thereon at predetermined intervals. This embodiment shows an example in which the six long-side hinge female portions H1 are formed. The long-side hinge female portions H1 are each formed to be as high as the long-side outer wall 12.

Further, the opposite short sides of the bottom portion 10 each have an outer wall (hereinafter referred to as a "short-side outer wall") 13 that is lower than the outer wall 12 formed on the long-side shoulder portion 11. Further, the bottom portion 10 has short-side hinge female portions H2 formed along each of the short-side outer walls 13 and in proximity thereto, the short-side hinge female portions H2 being each composed of a plate-shaped portion h1 and a hook h2 bent toward the short-side outer wall 13, the short-side hinge female portions H2 being similar to the long-side hinge female portions H1. This embodiment shows an example in which the four short-side hinge female portions H2 are disposed. The short-side hinge female portions H2 are each formed to be as high as the short-side outer wall 13.

The bottom portion 10 has a corner block 14 formed in each of the four corners thereof and which is generally L-shaped as viewed in plan and which extends upward beyond the long-side outer wall 12 and the short-side outer wall 13. A notched recess portion 14*b* is formed inside each of the corner blocks 14 and has a placement surface 14*a* formed thereon and which is substantially as high as the long-side hinge female portion H1 and the long-side outer wall 12.

15 is an appropriate number of plate-shaped ribs formed at predetermined intervals in corner portions each formed of a top surface of the long-side shoulder portion 11 and an inner wall surface of the long-side outer wall 12. The plate-shaped ribs 15 have a function of reinforcing the long-side outer walls 12. 16 is an appropriate number of plate-shaped ribs formed at predetermined intervals in corner portions each formed of a top surface of the bottom portion 10 and an inner wall surface of the short-side outer wall 13. The plate-shaped ribs 16 are similar to the plate-shaped ribs 15, and have a function of reinforcing the short-side outer walls 13.

17 is a long-side protruding portion formed by extending a central portion of the long-side shoulder portion 11 up to the upper end of the long-side outer wall 12 by a predetermined width, the long-side protruding portion 17 having a generally inversely U-shaped cross section that is perpendicular to the longitudinal direction of the bottom portion 10. The long-side protruding portion 17 is composed of a top portion 17*a* that is substantially flush with the upper end of the log-side outer wall 12, an inner wall 17*b* that is flush with an inner wall 11*b* of the long-side shoulder portion 11, and opposite side walls 17*c* that are similar to the plate-shaped ribs 15. The long-side protruding portion 17 has an opening at the bottom thereof and is internally formed as a cavity. 18 is a short-side protruding portion formed by bulging, by a predetermined width, a central portion of the bottom portion 10 which is close to the short-side outer wall 13, the short-side protruding portion 18 having a generally inversely U-shaped cross section that is perpendicular to the longitudinal direction of the bottom portion 10. The short-side protruding portion 18 is composed of a top portion 18*a* that is substantially flush with the upper end of the short-side outer wall 13, an inner wall 18*b* formed along the plate-shaped portion h1 constituting the short-side hinge female portion H2, and opposite side walls 17*c* that are similar to the plate-shaped ribs 16. The short-side protruding portion 18 has an opening at the bottom thereof and is internally formed as a cavity. The long-side protruding portion 17 and the short-side protruding portion 18 each have a function of increasing the strength and rigidity of the long and short sides of the bottom portion 10 and thus the strength and rigidity of the bottom portion 10.

The bottom portion 10 has a fitting portion 19 formed thereon and extending downward beyond the lower end 11*a*1 of the outer wall 11*a* constituting the long-side shoulder portion 11 and the lower end 13*a* of the short-side outer wall 13, the fitting portion 19 having a rectangular back surface and having a predetermined height. The fitting portion 19 is formed of long-side side walls 19*a* each formed by extending the inner wall 11*b* of the long-side shoulder portion 11 downward, short-side side walls 19*b* each located inside the short-side outer wall 13, and crossing ribs 19*c* formed in an area enclosed by the long-side side walls 19*a* and the short-side side walls 19*b*.

20 is an inversely trapezoidal protruding wall formed by extending a substantially central portion of the outer wall 11*a* constituting the long-side shoulder portion 11 so that the lower end 20*a* of the protruding wall 20 reaches the fitting portion 19. A clearance 20*b* is formed between the protruding wall 20 and the long-side side wall 19*a* of the fitting portion 19, and a pair of partitioning walls 21 are formed in the clearance 20*b* to bridge it. The protruding wall 20, the long-side side wall 19*a* of the fitting portion 19, and the pair of partitioning walls 21 form a long-side fitting recess portion 22 that is open at its bottom.

23 is an inversely trapezoidal protruding wall formed by extending a substantially central portion of the short-side outer wall 13 so that the lower end 23*a* of the protruding wall 23 reaches the fitting portion 19. A clearance 23*b* is formed between the protruding wall 23 and the short-side side wall 19*b* of the fitting portion 19, and a pair of partitioning walls 24 are formed in the clearance 23*a* to bridge it. The protruding wall 23, the short-side side wall 19*b*, and the pair of partitioning walls 21 form a short-side fitting recess portion 25 that is open at its bottom. 26 is reinforcing partitioning ribs formed in the inversely U-shaped long-side shoulder portions 11.

Figure 5:
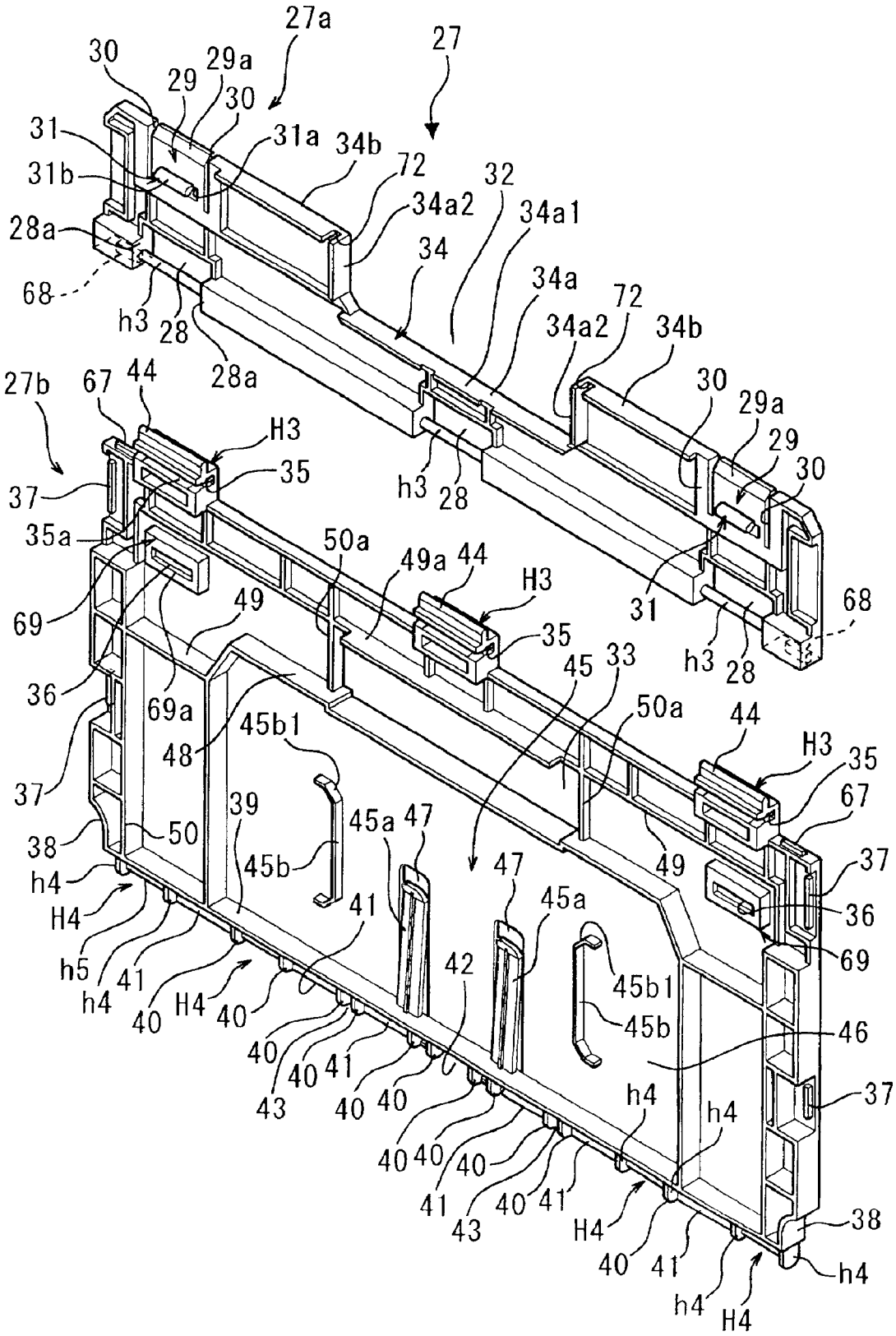
FIG. 5 is an exploded perspective view of a short side wall of a folding container of the present invention.
Figure 6:
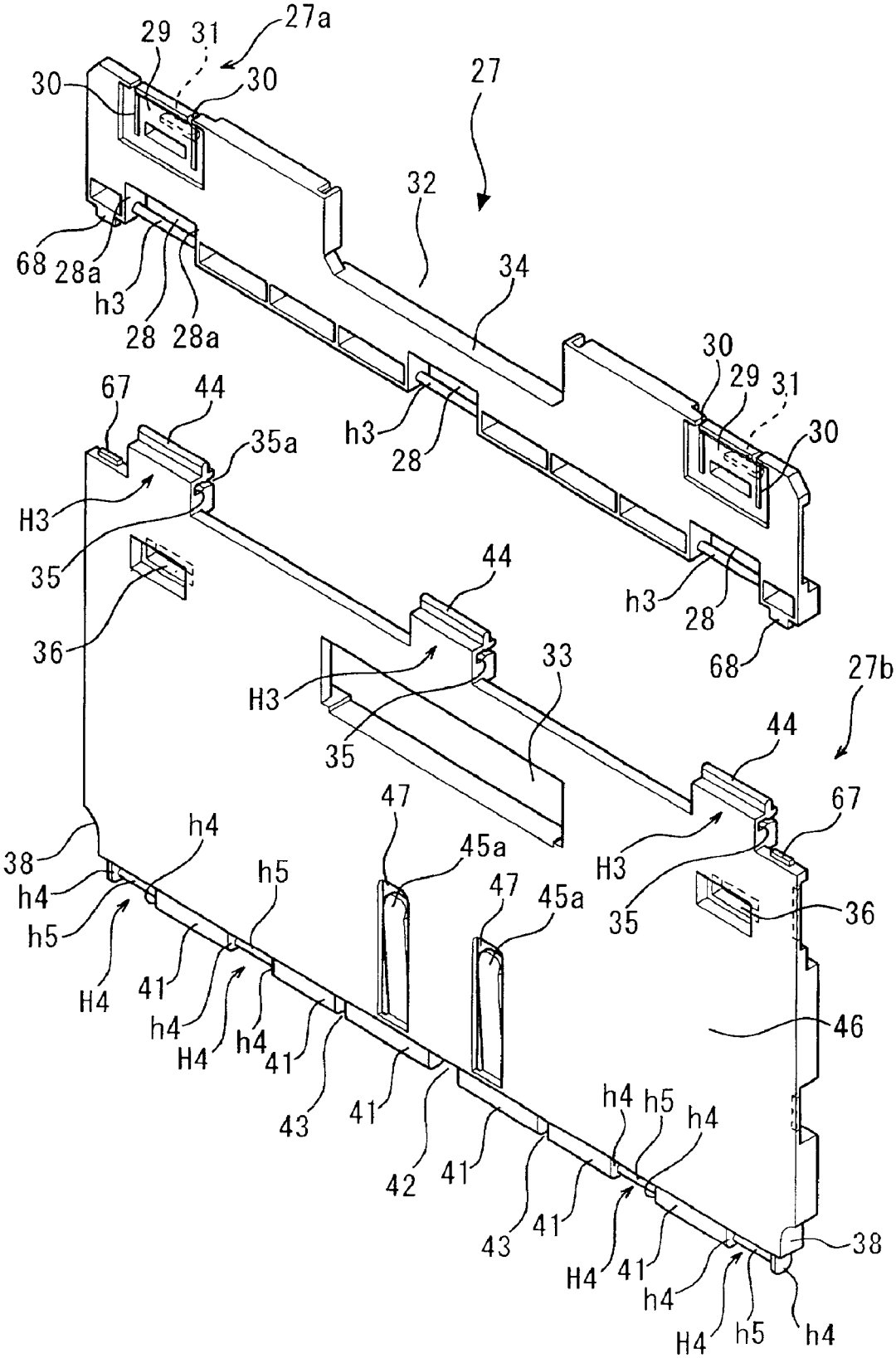
FIG. 6 is an exploded perspective view of the short side wall of the folding container of the present invention.

Now, a short side wall 27 will be described with reference to FIGS. 5 and 6.

The short side wall 27 is composed of an upper short side wall portion 27*a* and a lower short side wall portion 27*b* which are separated in a vertical direction and are each integrally molded of a synthetic resin. The upper short side wall portion 27*a* has recess portions 28 formed close to the lower opposite ends thereof and in a central portion thereof, respectively, and a horizontal pin h3 is attached inside the recess portion 28 to bridge across opposite sides 28*a* constituting the recess portion 28. 29 is tongue pieces each formed in an area close to a corresponding one of the opposite ends of the upper short side wall portion 27*a*. The tongue pieces 29 are each formed by forming a pair of parallel slits 30 so as to extend downward from the upper end of the upper short side wall portion 27*a* by a predetermined distance. The tongue piece 29 has an engagingly-locking protruding piece 31 protruding therefrom and formed of a horizontal portion 31*a* and a slightly bulging portion 31*b* formed thereon. 32 is a recess portion formed so as to correspond to a hand-held opening 33 formed in the lower short side wall portion 27. 34 is a flange formed in a central area of the upper end of the upper short side wall portion 27*a* and extending in the same direction as the engagingly-locking protruding piece 31. The flange 34 is formed of a U-shaped portion 34*a* formed in the center of the upper short side wall portion 27*a*, and horizontal portions 34*b* formed at the upper end of the upper short side wall portion 27*a*. In addition, the tangue piece 29 need not necessarily be formed by forming the pair of parallel slits 30.

The lower short side wall portion 27*b* has hinge female blocks H3 each formed close to the upper opposite ends thereof and in a central portion thereof and protruding upward. The hinge female blocks H3 each have a slit 35 into which the horizontal pin h3 attached inside the recess portion 28 in the upper short side wall portion 27*a* can be inserted and which extends along the cross direction of the lower short side wall portion 27*b*. An inlet portion 35*a* of the slit 35 has a height (the vertical height of the inlet portion 35*a* in FIGS. 5 and 6) slightly smaller than the diameter of the horizontal pin h3 so that the horizontal pin h3 inserted into the slit 35 will not slip out from the slit 35 easily. 36 is a pair of laterally long fitting slots each drilled in a box-shaped bulging portion 69 formed on the outer wall surface of the lower short side wall portion 27*b*. The fitting slots 36 are formed so that the corresponding engagingly-locking protruding piece 31 formed on the upper short side wall portion 27*a* can be fitted therein.

37 is elongate fitting protruding pieces protrusively formed close to each of the opposite perpendicular edges of the lower short side wall portion 27*b* and at a predetermined vertical interval. 38 is a notched portion formed in each of the opposite lower corners of the lower short side wall portion 27*b* so that when the folding container is assembled in a box form, those portions 14*c* of the corner blocks 14 formed in the four corners of the bottom portion 10 which are located in the short-side outer wall 13 side can be set in the corresponding notched portions 38, as described later.

A lower flange 39 extending horizontally from the lower end of the lower short side wall portion 27*b* has short-side-wall-side hinge male portions H4 formed on a bottom surface thereof and corresponding to the short side hinge female portions H2 formed along the short side outer wall 13 of the bottom portion 10. The short-side-wall-side hinge male portions H4 are each composed of support pieces h4 danglingly formed at a predetermined interval and having a pair of lower edges each shaped generally like a semicircle, and a horizontal pin h5 bridging across the pair of support pieces h4. 40 is a predetermined number of protruding pieces danglingly formed on the bottom surface of the lower flange 39 and which are similar to the support pieces h4. Connecting beams 41 are properly formed between the support piece h4 and the protruding piece 40, and between the adjacent protruding pieces 40, to connect the support piece h4 and the protruding piece 40 together, and the adjacent protruding pieces 40 together. 42 is a recess portion formed between the protruding pieces 40 formed in a central portion of the lower flange 39 so that when the folding container is assembled, the short-side protruding portion 18 of the bottom portion 10 can be set in this recess portion 42. Further, 43 also is a pair of slit-shaped recess portions each formed between the corresponding pair of protruding pieces 40 so that when the folding container is assembled, the plate-shaped rib 16 formed in each corner formed of the top surface of the bottom portion 10 and the inner wall surface of the short-side outer wall 13 can be set in this recess portion.

Each of the hinge female blocks H3 formed close to the opposite upper ends of the lower short side wall portion 27*b* and in the central portion thereof, respectively, has a projection 44 formed in a central portion of a top surface thereof and extending along the cross direction of the lower short side wall portion 27*b*. 45*a* is a card presser plate extending upward from a central portion of a top surface of the lower flange 39. In this embodiment, two card presser plates 45*a* are formed at a predetermined interval so that a clearance into which a card can be inserted can be formed between the card presser plates 45*a* and the plate-shaped portion 46 of the lower short side wall portion 27*b* by moving the card presser plates 45*a* outward against the elasticity thereof. 45*b* is a pair of card regulating longitudinal ribs formed on the plate-shaped portion 46 of the lower short side wall portion 27*b* located outside the pair of card presser plates 45*a*. The pair of card regulating longitudinal ribs 45*b* each have an inclined portion 45*b*1 formed at the top thereof and inclined in the direction in which the inclined portion 45*b*1 are separated from each other, and the pair of card presser plates 45*a* and the pair of card regulating longitudinal ribs 45*b* constitute a card instituting member 45. 47 is die inserting slots formed by injection-molding the card presser plates 45*a* formed on the plate-shaped portion 46 of the lower short side wall portion 27*b*.

48 is a generally inversely U-shaped rib formed to surround the card inserting member 45 and the opposite ends of which are connected to the lower flange 39. 49 is an appropriate number of lateral ribs formed at appropriate locations of the plate-shaped portion 46 of the lower short side wall portion 27*b*, and likewise 50 is an appropriate number of longitudinal ribs formed at appropriate locations of the plate-shaped portion 46 of the lower short side wall portion 27*b*. These ribs 49, 50 are suitably formed as required in order to reinforce the lower short side wall portion 27*b*.

The upper short side wall portion 27*a* and the lower short side wall portion 27*b* constructed as described above are hinged together by fitting the horizontal pins h3 bridging the recess portions 28 formed close to the opposite upper ends of the upper short side wall portion 27*a* and in the central portion thereof, respectively, in the corresponding slits 35 in the hinge female blocks H3 formed close to the opposite upper ends of the lower short side wall portion 27*b* and in the central portion thereof, respectively, so that the inlet portions 35*a* of the slits 35 can be pushed open. Thus, a hinge portion composed of the hinge female block H3 and the horizontal pin h3 can be used to rotationally move the upper short side wall portion 27*a* relative to the lower short side wall portion 27*b*. The upper short side wall portion 27*a* and the lower short side wall portion 27*b*, which are hinged together, are arranged so as to be flush with each other, and are connected together so that the fitting protruding pieces 37 protrusively formed close to each of the opposite perpendicular edges of the lower short side wall portion 27*b*, a lateral rib 49, a longitudinal rib 50, the engagingly-locking protruding pieces 31 protrusively formed on the tongue pieces 29 of the upper short side wall portion 27*a*, and others are located on the same side, and are located outside when the folding container is assembled in a box form, as described later. Preferably, when the folding container is assembled in a box form, the wall surfaces of the upper short side wall portion 27*a* and lower short side wall portion 27*b* located inside the folding container form an even and smooth surface. Such a smooth surface prevents articles accommodated in the folding container from being damaged.

Figure 7:
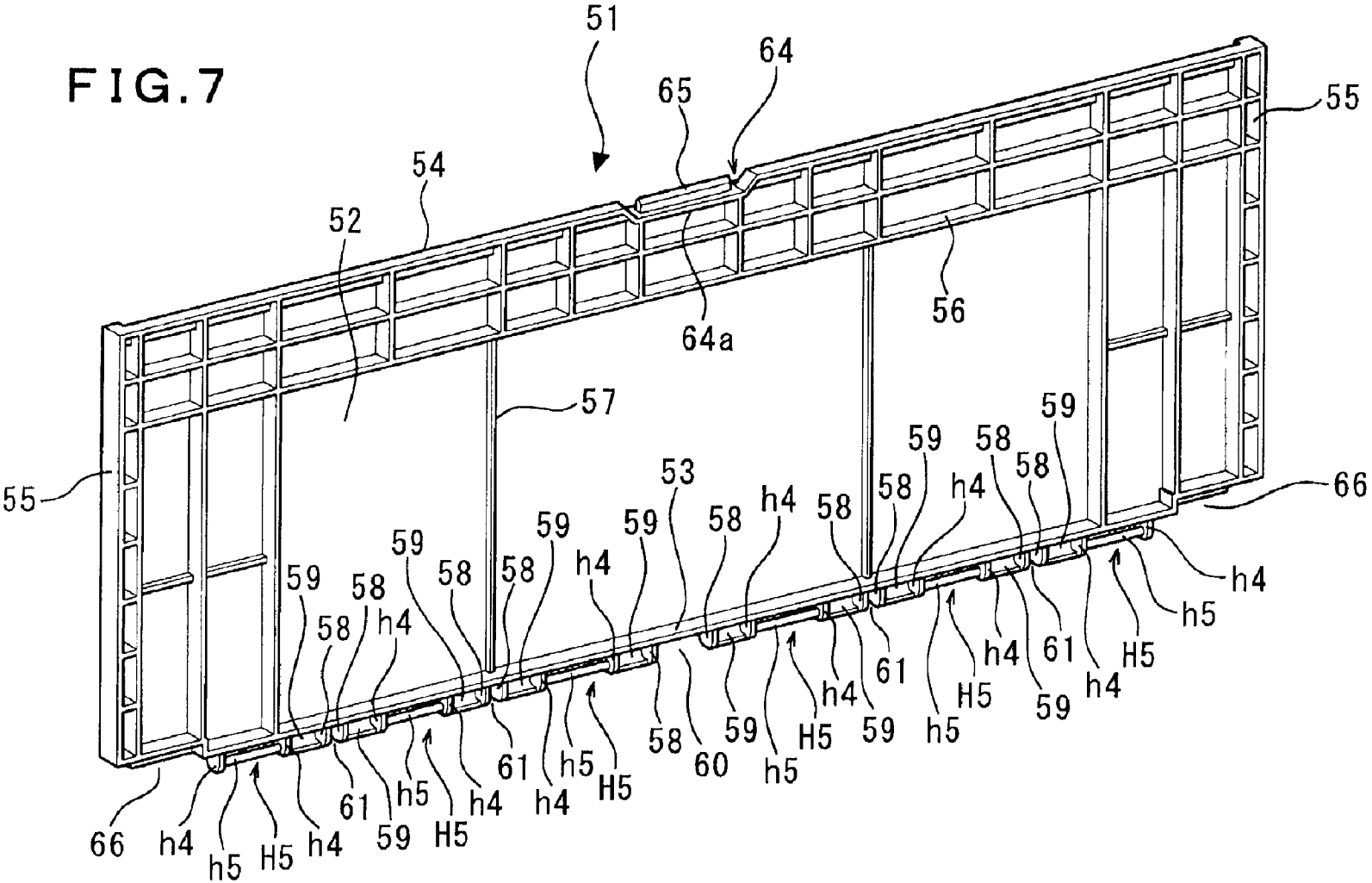
FIG. 7 is a perspective view of a long side wall of the folding container of the present invention.
Figure 8:
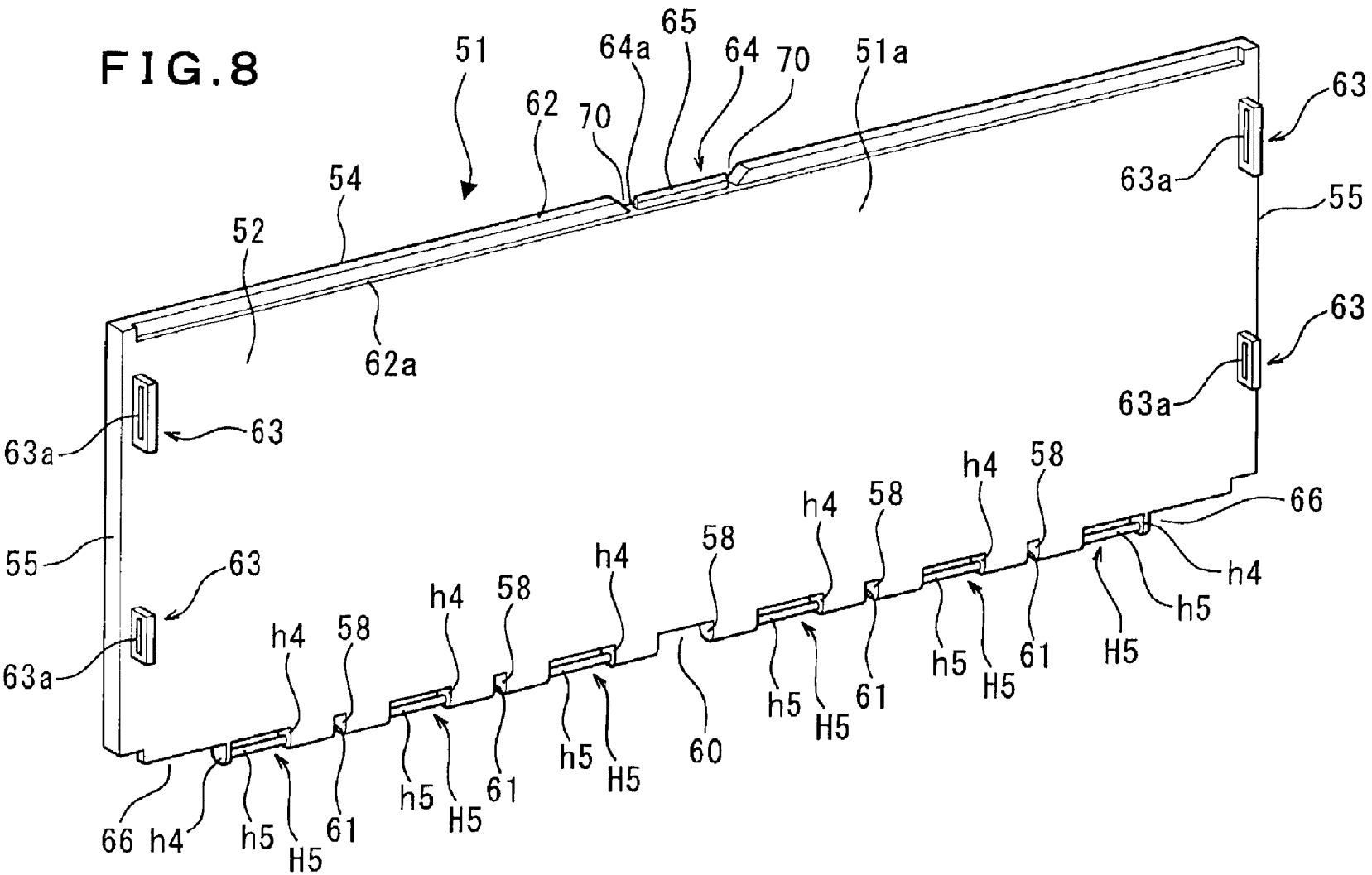
FIG. 8 is a perspective view of the long side wall of the folding container of the present invention.

Next, a long side wall 51 integrally molded of a synthetic resin will be described with reference to FIGS. 7 and 8.

The long side wall 51 has a laterally long plate-shaped portion 52, a lower flange 53 extending from the lower end of the laterally long plate-shaped portion 52 in the horizontal direction, an upper flange 54 extending from the upper end of the laterally long plate-shaped portion 52 in the horizontal direction, and perpendicular flanges 55 each formed at a corresponding one of the opposite ends of the laterally long plate-shaped portion 52 to connect the opposite ends of the lower flange 53 to the corresponding ends of the upper flange 54. The plate-shaped portion 52 surrounded by the lower flange 53, the upper flange 54, and the perpendicular flanges 55 has an appropriate number of lateral ribs 56 and longitudinal ribs 57 as required.

The lower flange 53 of the long side wall 51 has long-side-wall-side hinge male portions H5 formed on a bottom surface thereof and corresponding to the long-side hinge female portions H1 formed on the inner top surface of the long-side shoulder portion 11 of the bottom portion 10 described above. Like the above described short-side-wall-side hinge male portions H4, the long-sidewall-side hinge female portions H5 are each composed of support pieces h4 danglingly formed at a predetermined interval and having a pair of lower edges each shaped generally like a semicircle, and a horizontal pin h5 bridging across the pair of support pieces h4. 58 is a predetermined number of protruding pieces danglingly formed on the bottom surface of the lower flange 53 and which are similar to the support pieces h4. 60 is a recess portion formed between the protruding pieces 58 formed in a central portion of the lower flange 53 so that when the folding container is assembled, the long-side protruding portion 17 of the bottom portion 10 can be set in this recess portion 60. 61 also is an appropriate number of slit-shaped recess portions each formed between the corresponding pair of protruding pieces 50 so that when the folding container is assembled, the plate-shaped rib 15 formed in each corner formed of the top surface of the long-side shoulder portion 11 and the inner wall surface of the long-side outer wall 12 can be set in this slit-shaped recess portion 61.

The long side wall 51 has a notched portion 62 formed inside the upper end thereof and having a placement surface 62*a*. 63 is fitting pieces protrusively formed close to each of the opposite ends of the inner wall surface 51*a* of the long side wall 51 and at a predetermined vertical interval. The fitting piece 63 has an elongate through-slot 63*a* drilled therein and into which can be inserted the corresponding fitting protruding piece 37 protrusively formed close to the corresponding one of the opposite perpendicular edges of the lower short side wall portion 27*b* described above. The long side wall 51 has an inversely trapezoidal recess portion 64 having a bottom surface 64*a* that is flush with the placement surface 62*a*, and a projection 65 formed along the cross direction of the long side wall 51 so as to protrude from a bottom surface 64*a* of the recess portion 64 to the extent that it does not extend beyond the upper flange 54. 66 is a notched portion formed in each of the lower corners of the long side wall 52 so that when the folding container is assembled in a box form, that portion 14*d* of the corner block 14 formed in the corresponding one of the four corners of the above described bottom portion 10 which is located in the long-side outer wall 12 side can be set in this notched portion, as described later.

Now, an explanation will be given of an operation of assembling the bottom portion 10, the short side walls 27, and the long side walls 51 into a folding container.

To connect the bottom portion 10 to the short side walls 27 each composed of the upper short side wall portion 27*a* and lower short side wall portion 27*b* hinged together as described above, each of the horizontal pins h5 of the short-side-wall-side hinge male portions H4 formed on the bottom surface of the lower flange 39 of the lower short side wall portion 27*b* is fitted in the clearance between the corresponding short-side outer wall 13 of the bottom portion 10 and the corresponding one of the hooks h2 of the short-side hinge female portions H2 formed along the short-side outer wall 13, and the horizontal pins h5 are set on the corresponding hooks h2 of the short-side hinge female portions H2 of the bottom portion 10 to hinge the bottom portion 10 to the lower short side wall portion 27*b* constituting the short side wall 27.

Further, to connect the bottom portion 10 to the long side walls 51, each of the horizontal pins h5 of the long-side-wall-side hinge male portions H5 formed on the bottom surface of the lower flange 53 of the long side wall 51 is fitted in the clearance between the corresponding long-side outer wall 12 and the corresponding hook h2 of the long-side hinge female portion H1 formed on the inner top surface of the long-side shoulder portion 11 of the bottom portion 10, and the horizontal pins h5 are set on the corresponding hooks h2 of the long-side hinge female portions H1 of the bottom portion 10 to hinge the bottom portion 10 and the long side walls 51 together. In this manner, the bottom portion 10 is hinged to the short side walls 27 each composed of the upper short side wall portion 27*a* and the lower short side wall portion 27*b*, and to the long side walls 51, thereby assembling a folding container.

Next, an operation of assembling the folded folding container in a box form will be described with reference to FIGS. 9 to 17.

Figure 12:
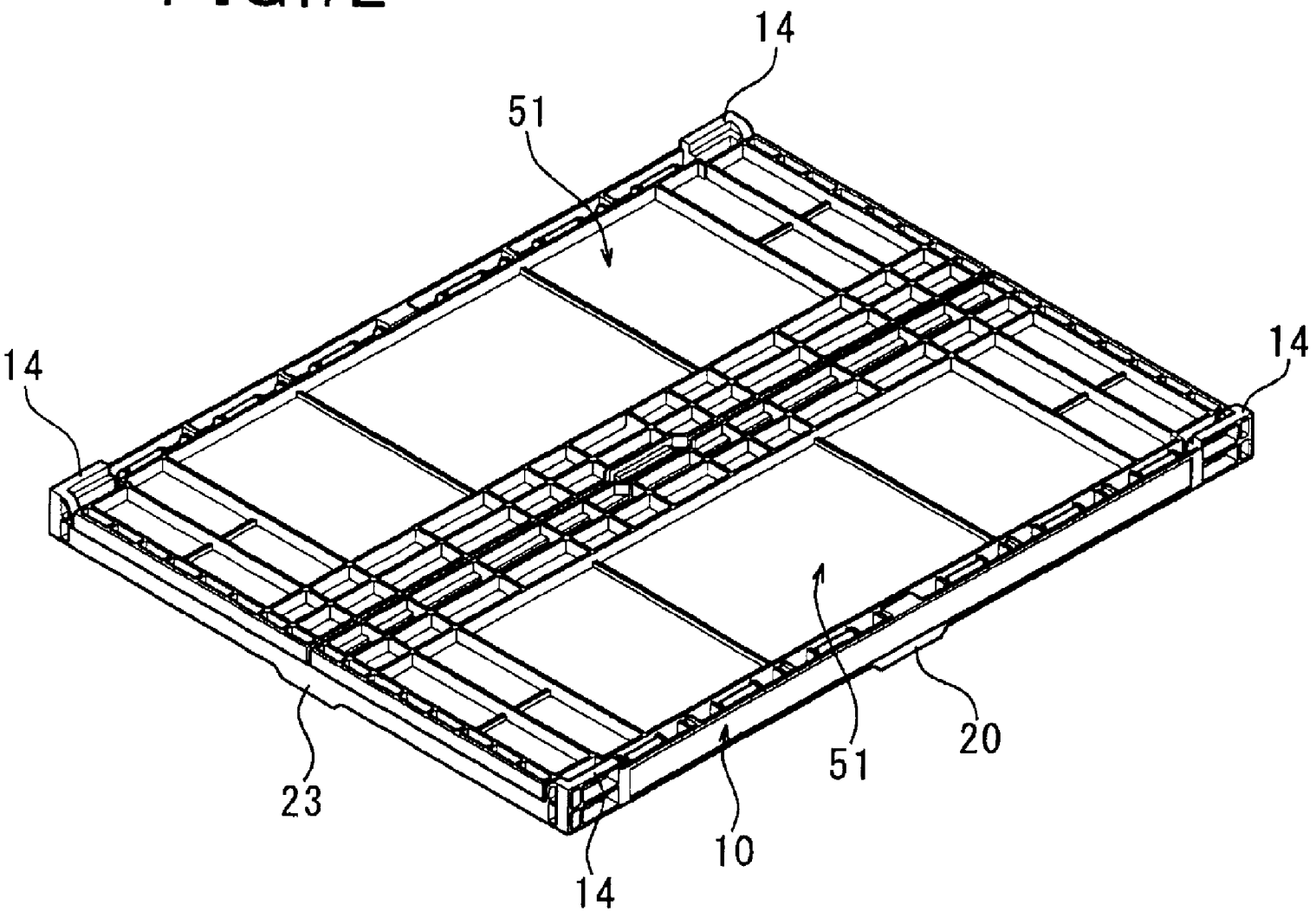
FIG. 12 is a perspective view showing the folded folding container of the present invention.

With the folding container folded as shown in FIG. 12, the upper short side wall portion 27*a* and the lower short side wall portion 27*b* hinged together so as to constitute each short side wall 27 are substantially flush with each other and are placed on the bottom portion 10. In other words, both the upper short side wall portions 27*a* and the lower short side wall portions 27*b* are deployed on the bottom portion 10. Then, the long side walls 51 are placed on the upper short side wall portions 27*a* and the lower short side wall portions 27*b* deployed on the bottom portion 10, thereby folding the folding container as shown in FIG. 12.

Figure 11:
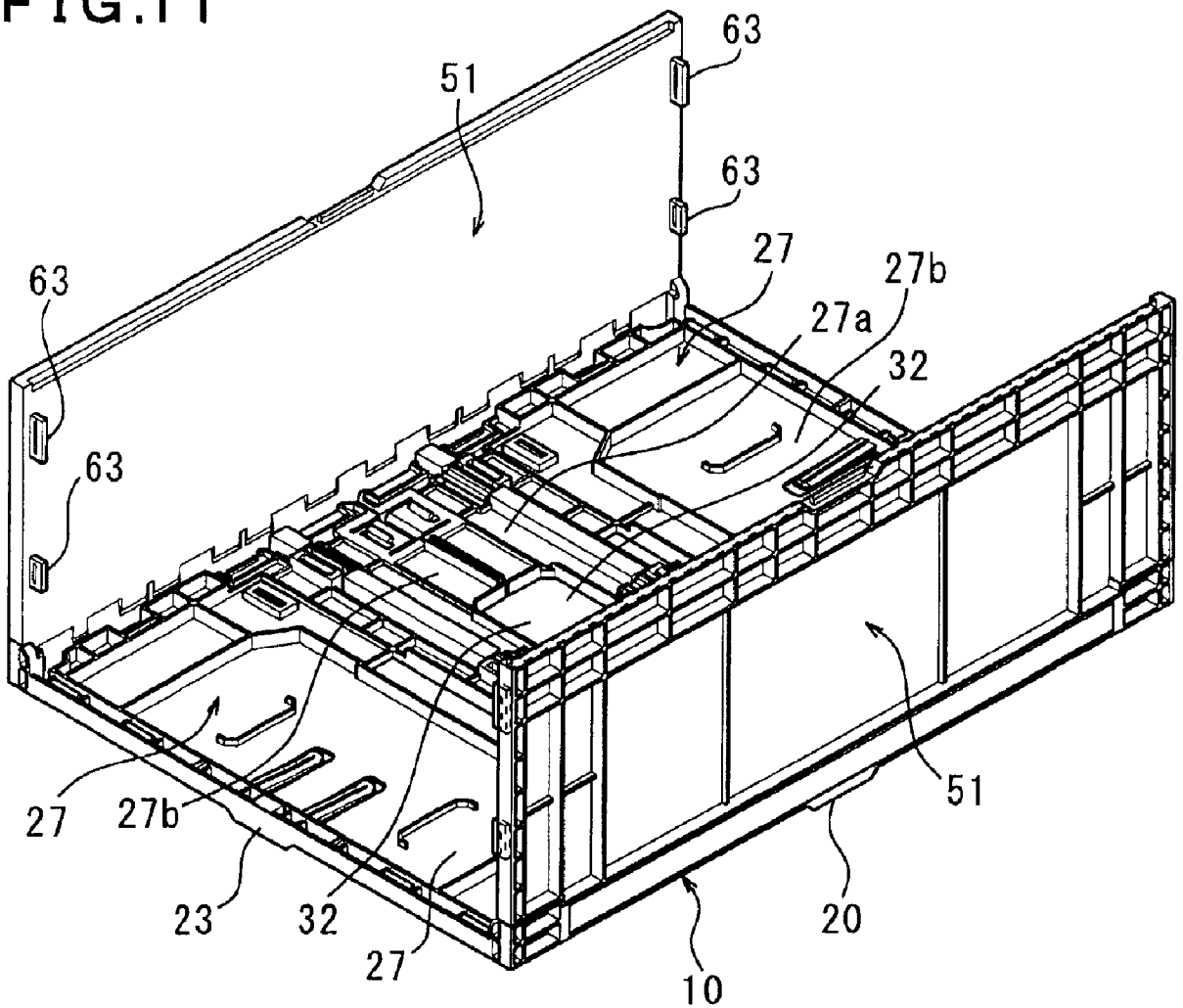
FIG. 11 is a perspective view of the folding container of the present invention, which is being folded or assembled.

With the folding container folded as shown in FIG. 12, first, the long side walls 51 placed on the upper short side wall portions 27*a* and the lower short side wall portions 27*b* constituting the short side walls 27 are rotationally moved so as to stand substantially perpendicular to the bottom portion 10 as shown in FIG. 11.

Figure 13:
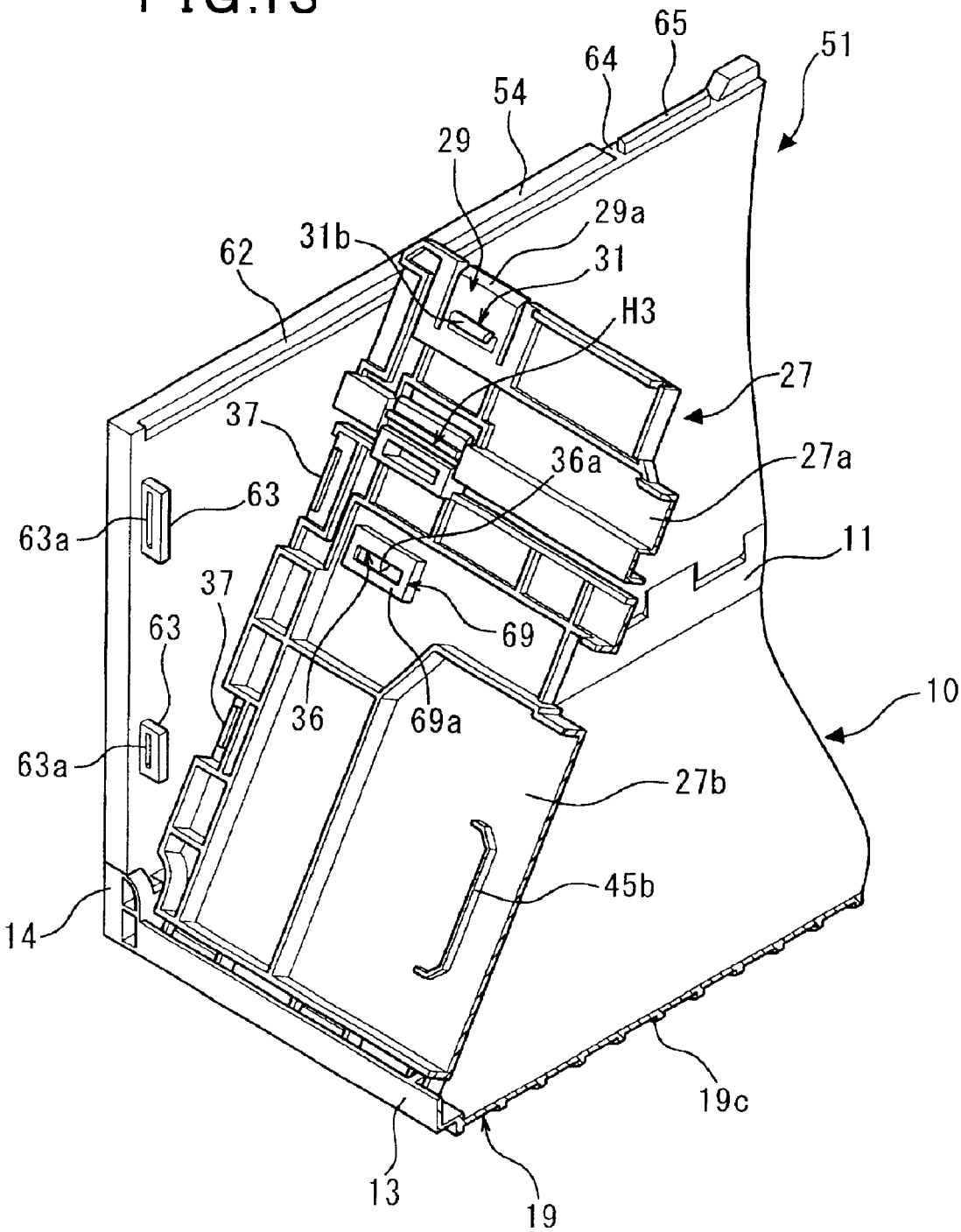
FIG. 13 is a partially enlarged perspective view of the folding container of the present invention, which is being folded or assembled.
Figure 14:
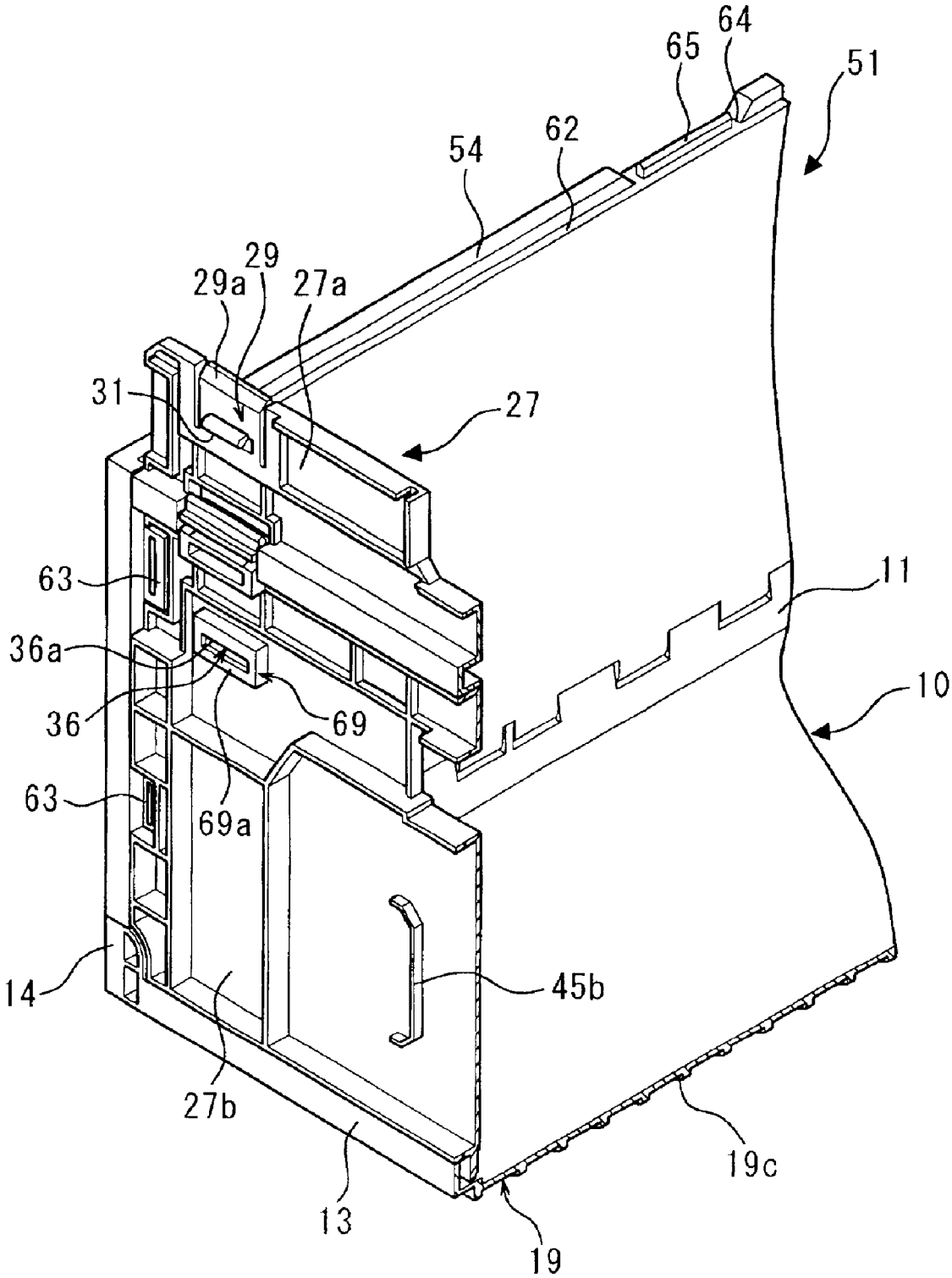
FIG. 14 is a partially enlarged perspective view of the folding container of the present invention, which is being folded or assembled.
Figure 15:
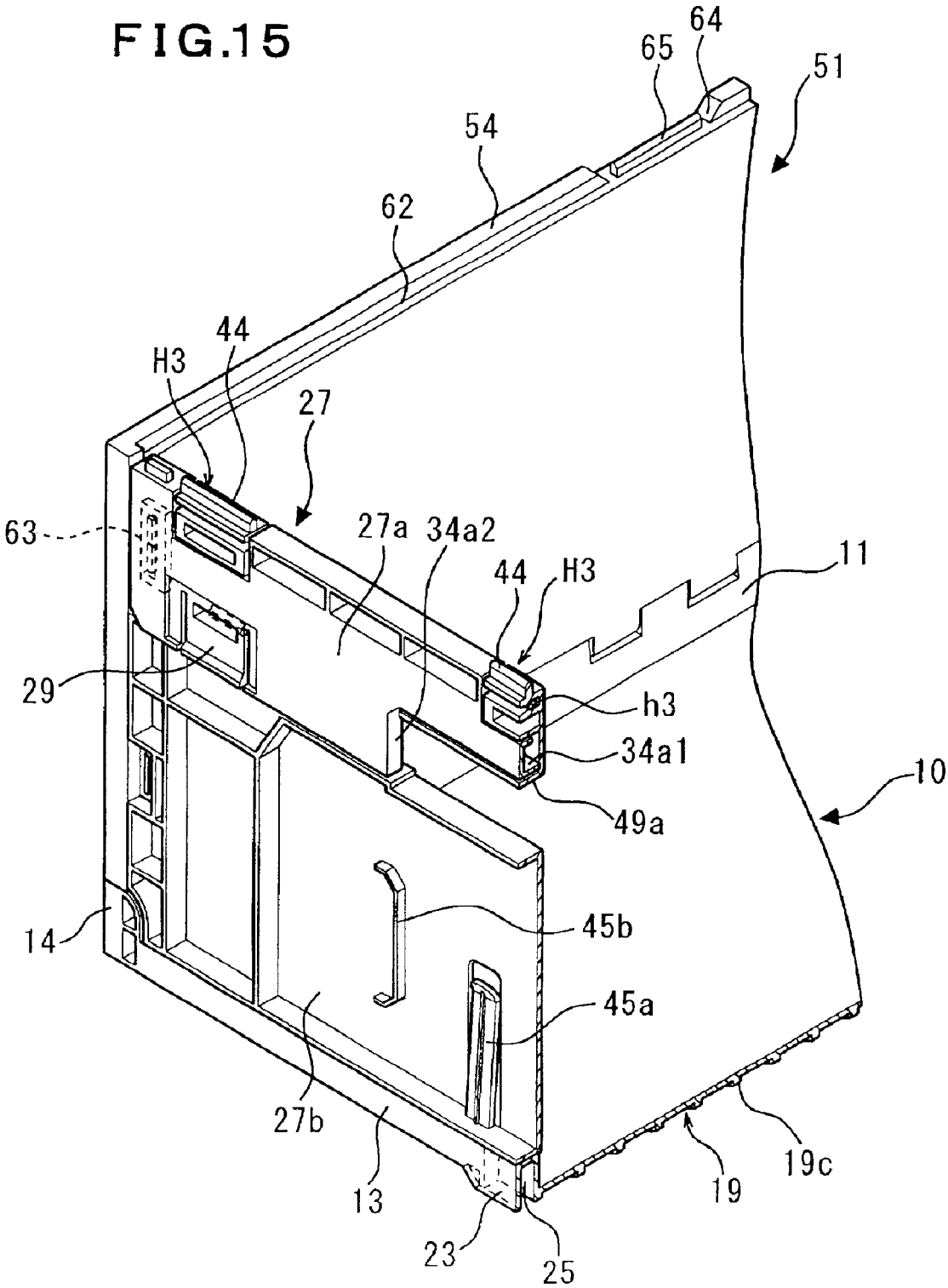
FIG. 15 is a partially enlarged perspective view of the folding container of the present invention, which has been assembled in a box form.

Then, as shown in FIG. 13, the upper short side wall portion 27*a* and the lower short side wall portion 27*b*, which are deployed, are rotationally moved in the perpendicular direction. Then, at locations close to the opposite ends of the inner wall surface 51*a* of the long side wall 51 set to stand substantially perpendicular to the bottom portion 10, the fitting projecting pieces 37 each formed close to each of the opposite perpendicular edges of the lower short side wall portion 27*b* is inserted into the corresponding through-slots 63*a* drilled in the fitting pieces 63 protrusively formed at the predetermined vertical interval. Thus, the upper short side wall portion 27*a* and the lower short side wall portion 27*b*, which remain deployed, are set to stand substantially perpendicular to the bottom portion 10 as shown in FIGS. 10 to 14. Subsequently, the upper short side wall portion 27*a* is rotationally moved outwardly around the hinge portion composed of the hinge female blocks H3 and the horizontal pins h3, to fit the engagingly-locking protruding pieces 31 protrusively formed on the tongue portions 29 formed close to each of the opposite ends of the upper short side wall portion 27*a*, in the corresponding laterally long fitting slots 36 formed under the hinge female blocks H3 of the lower short side wall portion 27*b*. Thus, as shown in FIGS. 9 and 15, the folding container is assembled in a box form by placing each upper short side wall portion 27*a* on the corresponding lower short side wall portion 27*b*.

Figure 16:
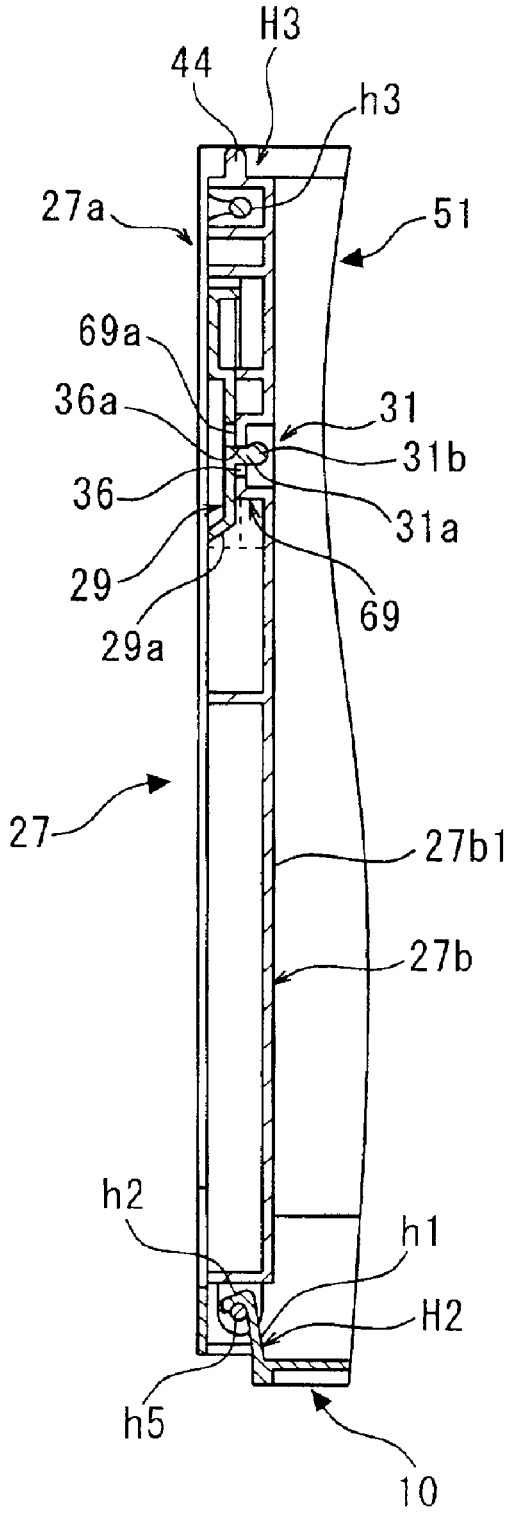
FIG. 16 is a vertical sectional view taken along the long side wall of the folding container of the present invention, which has been assembled in a box form.

When the engagingly-locking protruding pieces 31 protrusively formed on the tongue portions 29 formed close to each of the opposite ends of the upper short side wall portion 27*a* are fitted in the corresponding laterally long fitting slots 36 formed under the hinge female blocks H3 of the lower short side wall portion 27*b*, the bulging portions 31*b* each formed at the tip of the horizontal portion 31*a* of the engagingly-locking protruding piece 31 abut against the corresponding upper edges 36*a* of the fitting slots 36 in the lower short side wall portion 27*b* to bend the horizontal portions 31*a* of the engagingly-locking protruding pieces 31 downward because of the elasticity thereof. As a result, the bulging portions 31*b* of the engagingly-locking protruding pieces 31 pass through the corresponding fitting slots 36 in the lower short side wall portion 27*b*, and after the passage through the fitting slots 36, the horizontal portions 31*a* of the engagingly-locking protruding pieces 31 return to their original horizontal state owing to the elasticity thereof. Consequently, as shown in FIG. 16, the bulging portions 31*b* of the engagingly-locking protruding pieces 31 are set on the corresponding upper edges 36*a* of the fitting slots 36, and thus do not slip out from the corresponding fitting slots 36 of the lower short side wall portion 27*b* easily. Further, the engagingly-locking protruding pieces 31 are formed as the tongue pieces 29 each formed of the pair of parallel slits 30. Accordingly, since the tongue pieces 29 themselves have elasticity like the engagingly-locking protruding pieces 31, the insertion of the engagingly-locking protruding pieces 31 into the corresponding fitting slots 36 in the lower short side wall portion 27*b* facilitates a locking operation and an unlocking operation based on the removal of the engagingly-locking protruding pieces 31 from the corresponding fitting slots 36 in the lower short side wall portion 27*b*.

The tongue portions 29 each have an inclined surface 29*a* such that when the upper short side wall portion 27*a* and the lower short side wall portion 27*b* are placed on each other, a wedge-shaped cavity is formed between the tip of the tongue piece 29 and the lower short side wall portion 27*b*. When the upper short side wall portion 27*a* placed on the lower short side wall portion 27*b* is rotationally moved around the hinge portion composed of the hinge female blocks H3 and the horizontal pins h3 to remove the engagingly-locking protruding pieces 31 of the upper short side wall portion 27*a* from the corresponding fitting slots 36 in the lower short side wall portion 27*b*, an operator's finger is inserted into the cavity between the tip of each tongue piece 29 and the lower short side wall portion 27*b* to raise the tongue piece 29 upward. Thus, the bulging portions 31*b* of the engagingly-locking protruding pieces 31 can be easily removed from the corresponding upper edges 36*a* of the fitting slots 36, thereby facilitating the unlocking operation based on the removal of the engagingly-locking protruding pieces 31 from the corresponding fitting slots 36 in the lower short side wall portion 27*b*.

Figure 9:
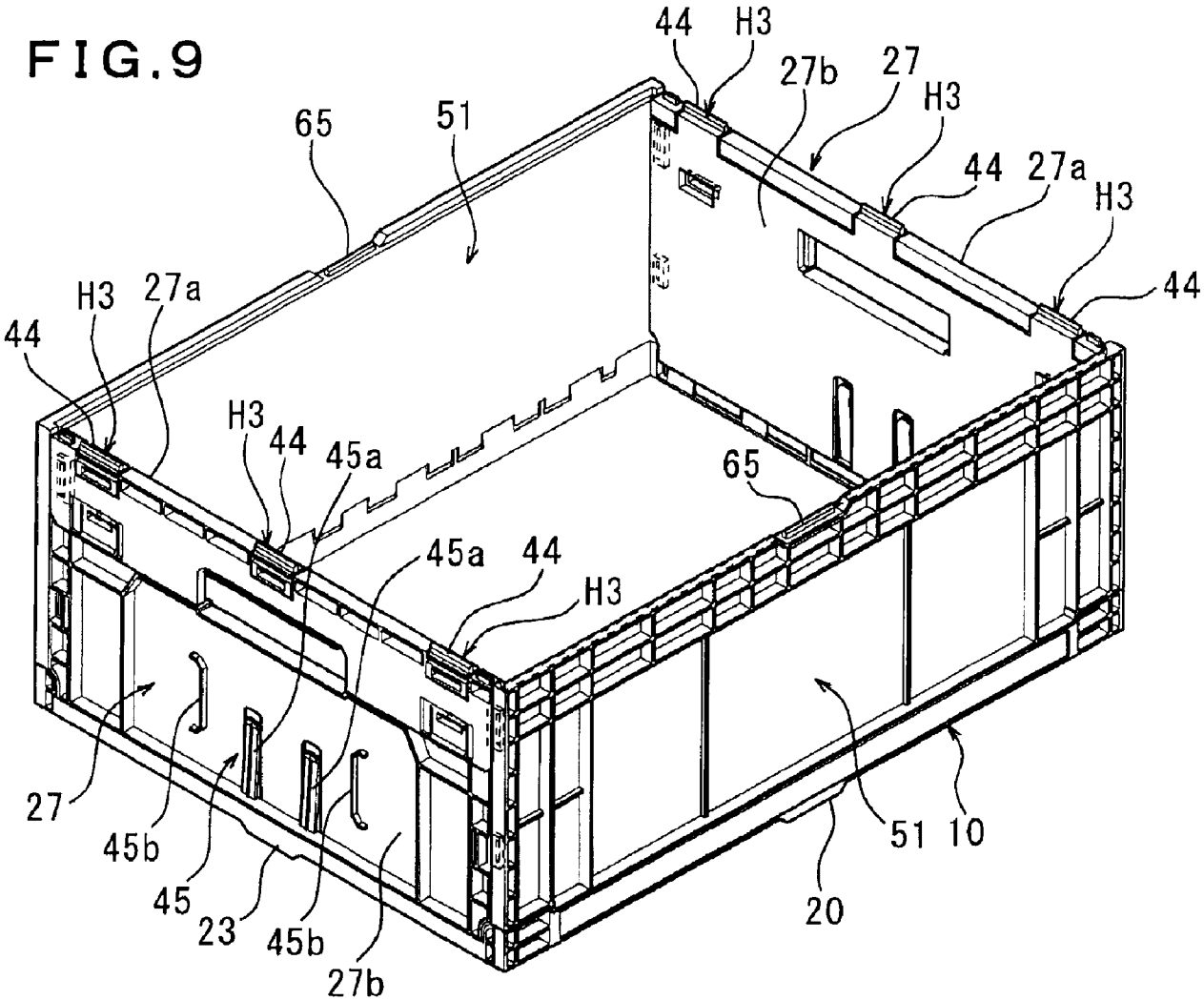
FIG. 9 is a perspective view of the folding container of the present invention, which has been assembled in a box form.

To fold the folding container assembled in a box form as shown in FIG. 9, in the manner shown in FIG. 12, the above described operation of assembling the container in a box form can be reversely performed. For this folding operation, the upper short side wall portion 27*a* placed on the lower short side wall portion 27*b* is rotationally moved around the hinge portion composed of the hinge female blocks H3 and the horizontal pins h3 to remove the engagingly-locking protruding pieces 31 of the upper short side wall portion 27*a* from the corresponding fitting slots 36 in the lower short side wall portion 27*b*, thereby rotationally moving the upper short side wall portion 27*a*. During the rotational movement of the upper short side wall portion 27*a*, if the lower short side wall portion 27*b* and the upper short side wall portion 27*a* are rotationally moved to the bottom portion 10 with the upper short side wall portion 27*a* further rotationally moved inwardly of the folding container, that is, with the lower short side wall portion 27*b* and the upper short side wall portion 27*a* inclined in an inversely V-shaped form or with the upper short side wall portion 27*a* placed on the lower short side wall portion 27*b* inside the folding container, then the operator must perform an extra operation such that the lower short side wall portion 27*b* and the upper short side wall portion 27*a* are deployed so as to be flush with each other. Consequently, the operation of folding the folding container will be inefficient.

Figure 10:
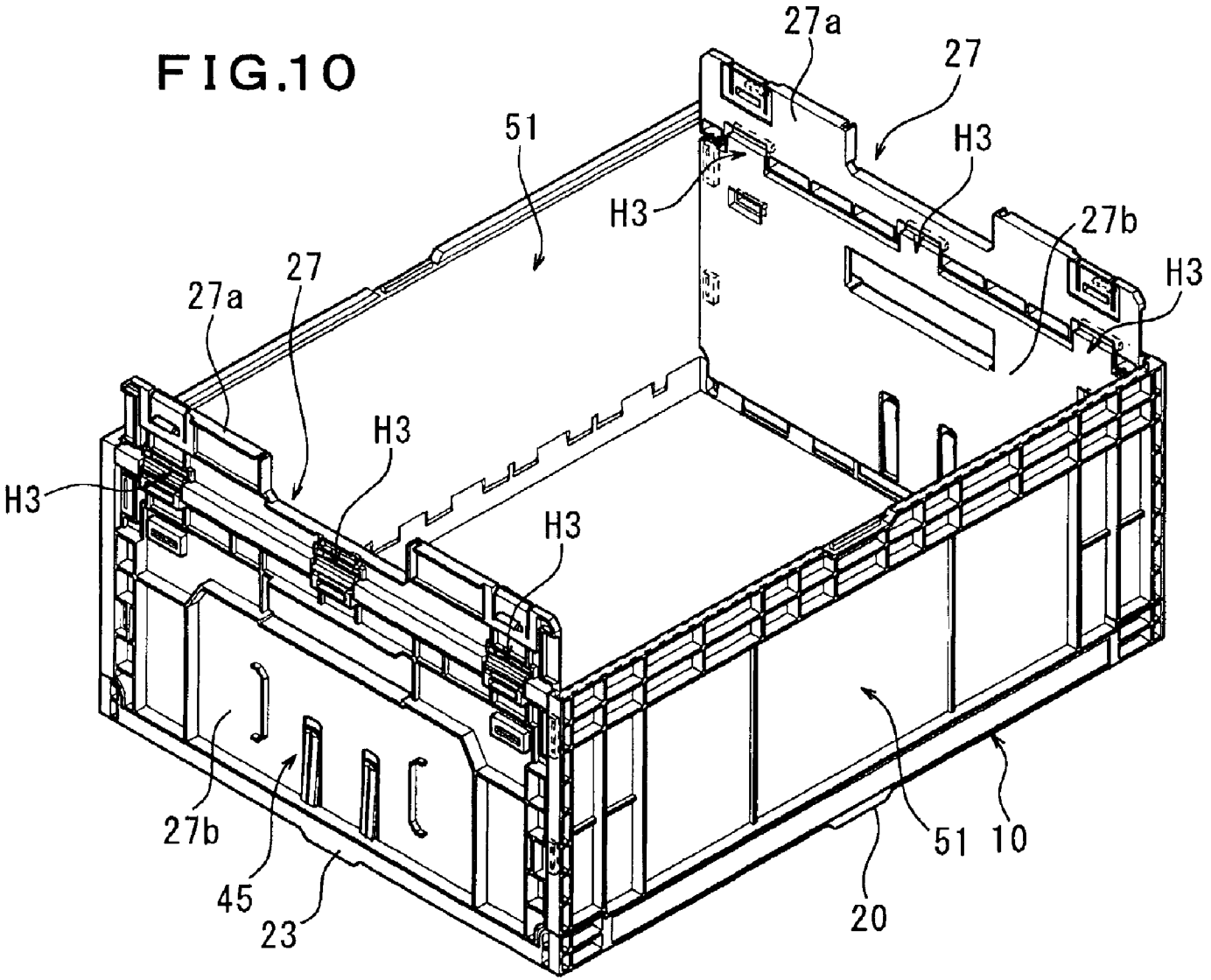
FIG. 10 is a perspective view of the folding container of the present invention, which is being folded or assembled.
Figure 17:
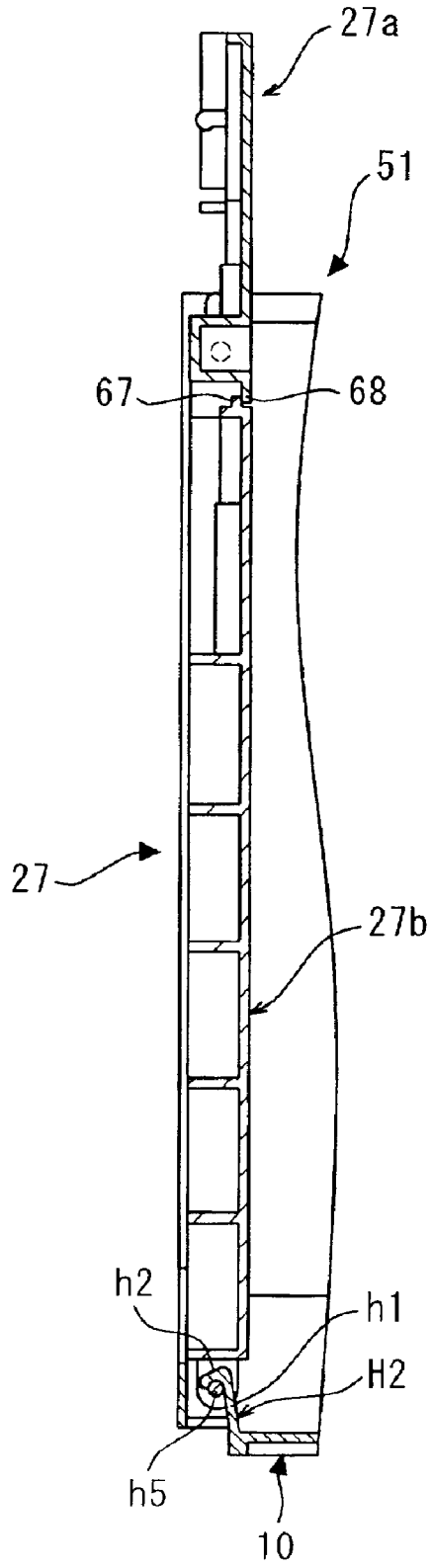
FIG. 17 is a vertical sectional view taken along the long side wall of the folding container of the present invention when an upper short side wall portion constituting the short side wall is rotated substantially through 180° from the state in which the folding container is assembled in a box form.

To solve the above described problem, the lower short side wall portion 27*b* has an inward-fall preventing protrusion 67 protrusively formed close to each of the opposite upper ends thereof, and the upper short side wall portion 27*a* has a similar inward-fall preventing protrusion 68 danglingly formed closed to each of the opposite lower ends thereof. After the lower short side wall portion 27*b* and the upper short side wall portion 27*a* of the folding container assembled in a box form as shown in FIGS. 10 and 14 have been placed on each other, the upper short side wall portion 27*a* is rotationally moved substantially through 180° until the lower short side wall portion 27*b* and the upper short side wall portion 27*a* are substantially flush with each other. Then, the inward-fall preventing protrusions 68 each danglingly formed close to the corresponding one of the opposite lower ends of upper short side wall portion 27*a* impact the corresponding inward-fall preventing protrusions 67 each protrusively formed close to the corresponding one of the opposite upper ends of the lower short side wall portion 27*b*, as shown in FIG. 17, thereby preventing the upper short side wall portion 27*a* from rotationally moving inwardly of the folding container from its perpendicular state. This construction serves to solve the above described problem to improve the efficiency of the operation of folding the folding container.

Further, in this embodiment, the laterally long fitting slots 36 formed under the hinge female blocks H3 of the lower short side wall portion 27*b* are formed on a front surface wall 69*a* that is parallel with the plate-shaped portion 46 of the outward-bulging box-shaped projecting portion 69. When the engagingly-locking protruding pieces 31 protrusively formed on the tongue portions 29 formed close to each of the opposite ends of the upper short side wall portion 27*a* are inserted into the corresponding fitting slots 36 formed in the front surface wall 69*a* of the box-shaped projecting portion 69 of the lower short side wall portion 27*b*, and the lower short side wall portion 27*b* and the upper short side wall portion 27*a* are then placed on each other to assemble the folding container in a box form, the engagingly-locking protruding pieces 31 do not protrude from the inner wall surface 27*b*1 of the lower short side wall portion 27*b*. This construction prevents articles accommodated in the folding container assembled in a box form from abutting against the engagingly-locking protruding pieces 31 to damage them.

Furthermore, preferably, when the lower short side wall portion 27*b* and the upper short side wall portion 27*a* constituting the short side wall 27 are deployed on the bottom portion 10 so as to be flush with each other as shown in FIG. 11, the clearance formed between the upper short side wall portions 27*a* of the opposite short side walls 27 is reduced. When a large clearance is formed between the upper short side wall portions 27*a* of the opposite short side walls 27, if external force is applied from above to the long side walls 51 placed on this clearance, portions of the long side walls 51 which are located on the clearance may be bent downward and damaged because these portions are not backed by the upper short side wall portion 27*a*, which supports external force. As shown in FIG. 11, substantially no clearance is preferably formed between the upper short side wall portions 27*a* of the opposite short side walls 27. In FIG. 11, only the clearance defined by the recess portions 32 each formed in the upper short side wall portion 27*a* correspondingly to the hand-held openings 33 each formed in the lower short side wall portion 27*b* is created between the upper short side wall portions 27*a* of the opposite short side walls 27.

Now, an operation of stacking folding containers assembled in a box form will be described mainly with reference to FIGS. 18 to 22.

Figure 18:
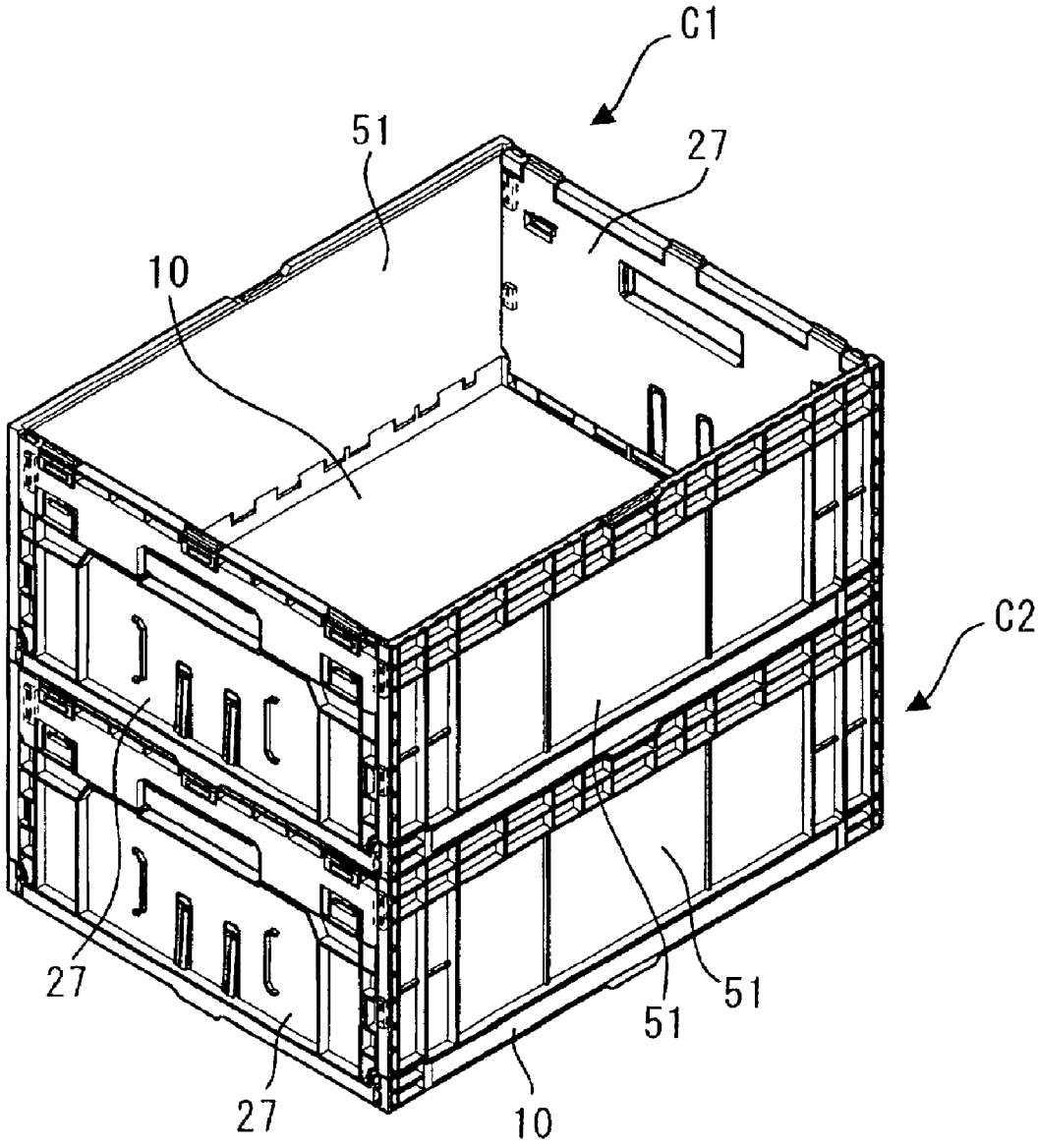
FIG. 18 is a perspective view showing two folding containers each assembled in a box form according to the present invention and which have been stacked together.
Figure 19:
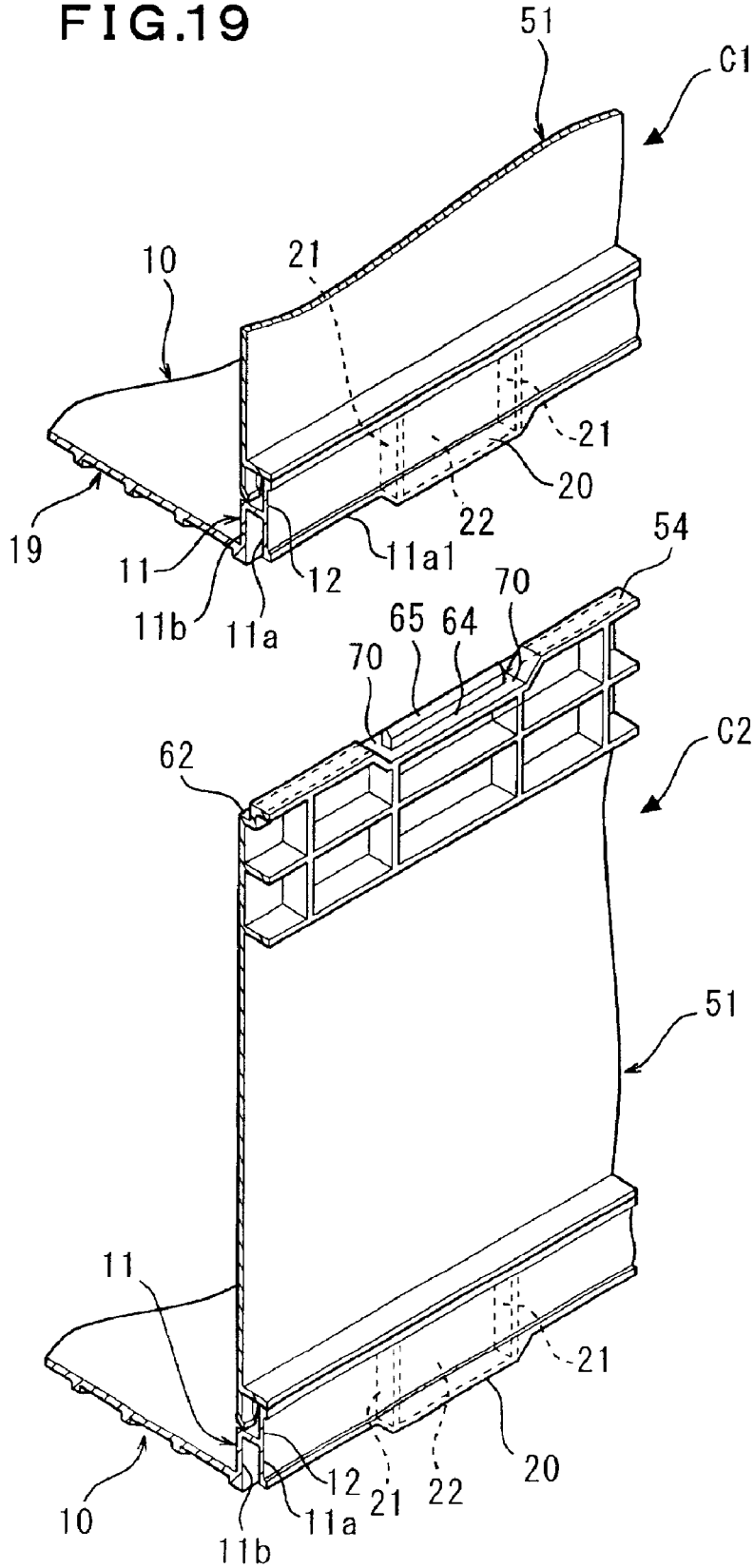
FIG. 19 is a perspective view showing a state immediately before the two folding containers each assembled in a box form according to the present invention are stacked together.
Figure 20:
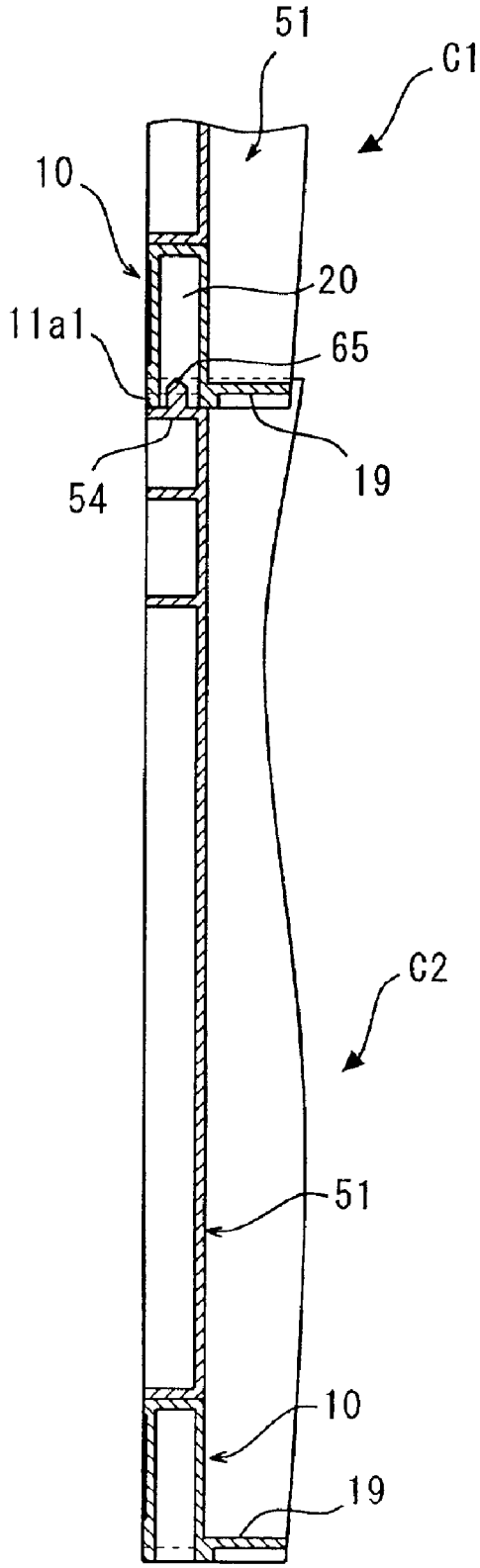
FIG. 20 is a partial vertical sectional view taken along the long side walls of the two folding containers each assembled in a box form according to the present invention and which have been stacked together.
Figure 21:
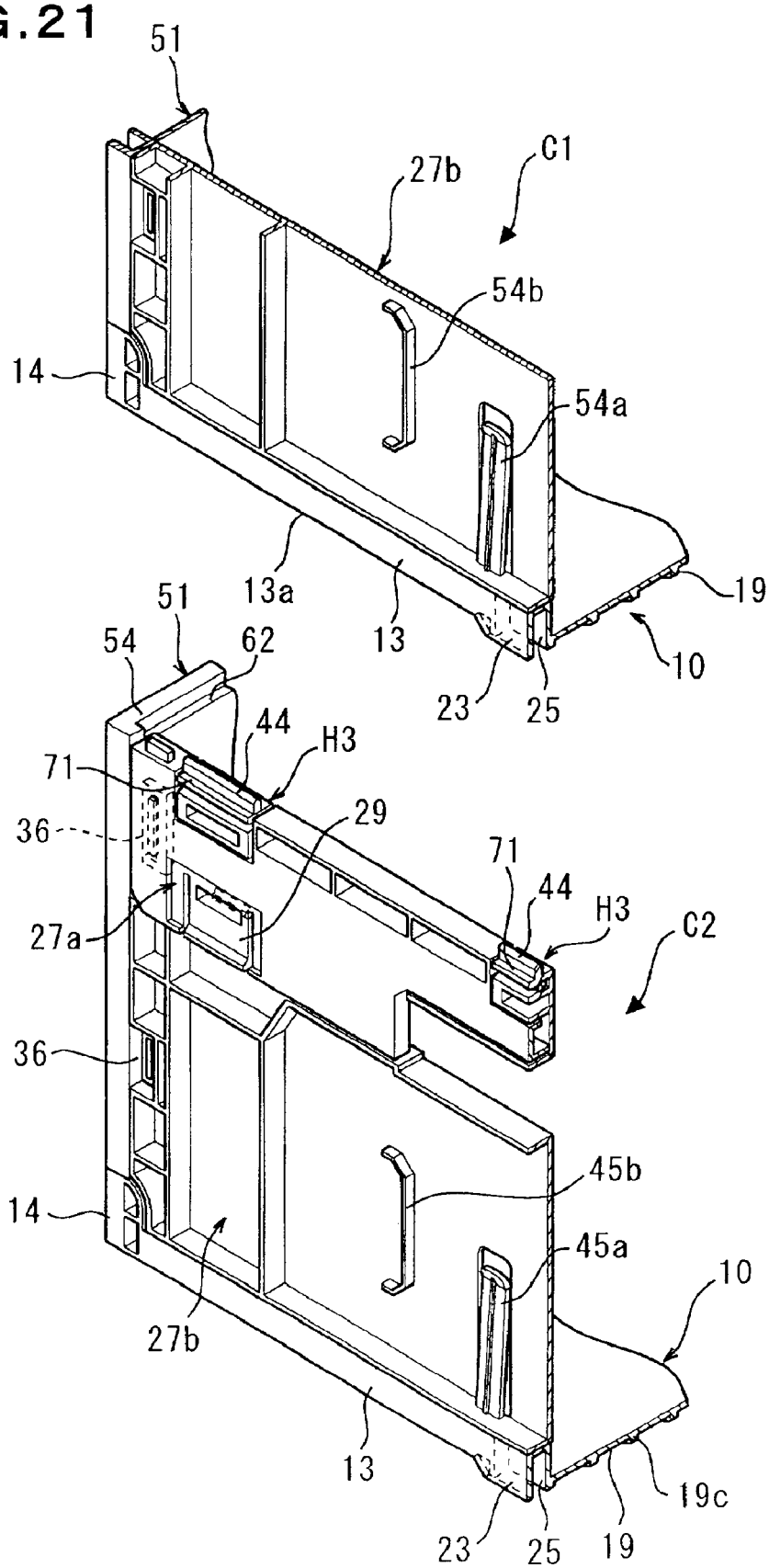
FIG. 21 is a perspective view showing a state immediately before the two folding containers each assembled in a box form according to the present invention are stacked together.

As shown in FIG. 18, a folding container C1 assembled in a box form and located above is stacked on a folding container C2 assembled in a box form and located below. In this case, the inversely trapezoidal protruding walls 20 each formed in the substantially central portion of the outer wall 11*a* constituting the long-side shoulder portion 11 of the bottom portion 10 of the folding container C1 assembled in a box form and located above are inserted into the corresponding inversely trapezoidal recess portions 64 each formed in the center of the upper end of the long side wall 51 of the folding container C2 assembled in a box form and located below. Further, as shown in FIG. 20, the projections 65 each protrusively formed on the bottom surface 64*a* of the recess portion 64 are inserted into the corresponding long-side fitting recess portions 22 each formed close to the central portion of the long-side shoulder portion 11 of the bottom portion 10. Then, the fitting portions 19 of the bottom portion 10 of the folding container C1 assembled in a box form and located above are set in the corresponding notched portions 62 each formed in the long side wall 51 of the folding container C2 assembled in a box form and located below. Further, the lower end hal of the outer wall 11*a* constituting the long-side shoulder portion 11 of the bottom portion 10 of the folding container C1 assembled in a box form and located above is placed on the upper flange 54 of the long side wall 51 of the folding container C2 assembled in a box form and located below. Furthermore, the partitioning walls 21 constituting the long-side fitting recess portions 22 in the bottom portion 10 of the folding container C1 assembled in a box form and located above is inserted into corresponding clearances 70 each located at a corresponding one of the opposite ends of the projections 65 formed on the long side wall 51 of the folding container C2 assembled in a box form and located below. This prevents the folding container C1 assembled in a box form and located above from moving along the long side walls 51 of the folding container C2 assembled in a box form and located below, and prevents the long side walls 51 of the folding container C2 assembled in a box form and located below from being bulged outward owing internal pressure exerted by articles in the container or the weight of the folding container C1 assembled in a box form and located above.

Figure 22:
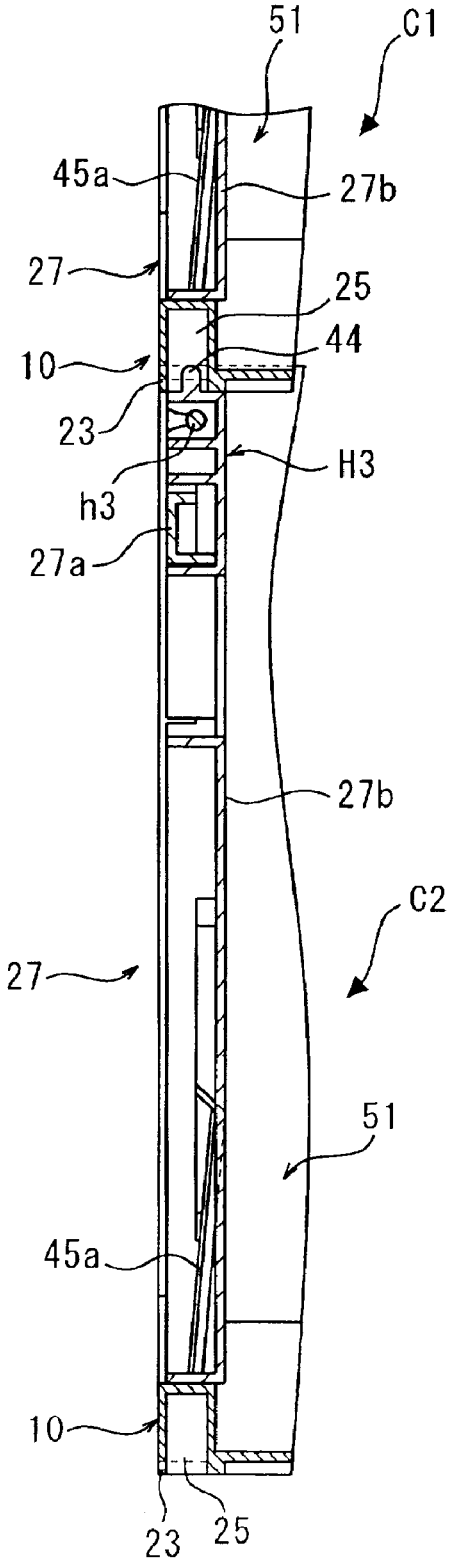
FIG. 22 is a partial vertical sectional view taken along the long side walls of the two folding containers each assembled in a box form according to the present invention and which have been stacked together.

Further, when the folding container C1 assembled in a box form and located above is stacked on the folding container C2 assembled in a box form and located below as shown in FIG. 18, the projections 44 each protrusively formed on the top surface of the hinge female block H3 formed in the central portion of the upper end of the lower short side wall portion 27*b* of the folding container C2 assembled in a box form and located below are inserted into the corresponding short-side fitting recess portions 25 each formed in the substantially central portion of the short-side outer wall 13 of the bottom portion 10 of the folding container C1 assembled in a box form and located above, as shown in FIG. 22. Further, the fitting portions 19 of the bottom portion 10 of the folding container C1 assembled in a box form and located above is set inside the corresponding projections 44 of the hinge female blocks H3 formed at the opposite upper ends and the central portion of the lower short side wall portion 27*b* of the folding container C2 assembled in a box form and located below. Furthermore, the lower end 13*a* of each short-side outer wall 13 of the bottom portion 10 of the folding container C1 assembled in a box form and located above is placed on top surfaces 71 of the hinge female blocks H3 each located outside the projection 44. This prevents the folding container C1 assembled in a box form and located above from moving along the short side walls 27 of the folding container C2 assembled in a box form and located below, and prevents the short side walls 27 of the folding container C2 assembled in a box form and located below from being bulged outward owing internal pressure exerted by articles in the container or the weight of the folding container C1 assembled in a box form and located above.

As described above, in the present invention, the short side wall 27 is divided into the upper short side wall portion 27*a* and the lower short side wall portion 27*b* via the hinge portion, and the upper short side wall portion 27*a* and the lower short side wall portion 27*b* are deployed on the bottom portion 10 rather than being placed on each other. Accordingly, the short side walls 27 as placed on the bottom portion 10 may be thinner than the conventional short side walls 3, thereby keeping the bottom portion 10 low. Therefore, folded folding containers can be more efficiently housed to save housing spaces.

Further, the long side wall 51 and the short side wall 27 are engaged with each other by inserting the fitting protruding pieces 37 formed on the lower short side wall portion 27*b* into the corresponding through-slots 63*a* in the fitting pieces 63 formed on the long side wall 51, rotationally moving the upper short side wall portion 27*a* so that the upper short side wall portion 27*a* overlaps the lower short side wall portion 27*b*, and then inserting the engagingly-locking protruding pieces 31 formed on the upper short side wall portion 27*a* into the corresponding fitting slots 36 formed in the lower short side wall portion 27*b*. Consequently, in an assembled state, the long side wall 51 and the short side wall 27 are not disengaged from each other even under external force. Moreover, the fitting protruding pieces 37 formed on the lower short side wall portion 27*b* are simply inserted into the corresponding through-slots 63*a* in the fitting pieces 63 formed on the long side wall 51. Accordingly, when the upper short side wall portion 27*a* is rotationally moved substantially through 180° in the direction in which it leaves the lower short side wall portion 27*b*, while the upper short side wall portion 27*a* and the lower short side wall portion 27*b* are rotationally moved to the bottom portion 10, as described above, the fitting protruding pieces 37 formed on the lower short side wall portion 27*b* can be removed from the corresponding through-slots 63*a* in the fitting pieces 63 formed on the long side wall 51, without any other operation. Therefore, the operation of folding the folding container will be more efficient.

Further, in the present invention, the short side wall 27 is formed of the two plate-shaped members including the upper short side wall portion 27*a* and the lower short side wall portion 27*b*, which are hinged together, so that when the folding container is assembled in a box form, the short side walls 27 are stronger than the conventional short side wall formed of a single plate-shaped member.

When the folding container is assembled in a box form as shown in FIGS. 9 and 15, the lower short side wall portion 27*b* and the upper short side wall portion 27*a* overlap each other so that the hand-held opening 33 formed in the lower short side wall portion 27*b* substantially aligns with the recess portion 32 formed in the upper short side wall portion 27*a*, as described above. Further, when the lower short side wall portion 27*b* and the upper short side wall portion 27*a* overlap each other, a central portion 34*a*1 of the U-shaped portion 34*a* of the flange 34 formed in the central portion of the upper end of the upper short side wall portion 27*a* is located on a lateral rib 49*a* extending from the upper edge of the hand-held opening 33 formed in the lower short side wall portion 27*b*, and substantially perpendicular portions 34*a*2 of the U-shaped portion 34*a* are each located inside a longitudinal rib 50*a* extending from a corresponding side edge of the hand-held opening 33 in the perpendicular direction. Furthermore, notched portions 72 are each formed at that end of the horizontal portion 34*b* which is located closer to the U-shaped portion 34*a* so that when the lower short side wall portion 27*b* and the upper short side wall portion 27*a* are placed on each other, the longitudinal ribs 50*a* extending from the corresponding side edges of the hand-held opening 33 in the perpendicular direction are inserted into the corresponding notched portions 72.

In the present invention, as described above, the projection 65 protrusively formed on the bottom surface 64*a* of the recess portion 64 in the center of the upper end of the long side wall 51 is formed so as not to extend beyond the upper flange 54. Further, when the folding container is assembled in a box form, the projections 44 each protrusively formed on the top surface of the hinge female block H3 formed on the lower short side wall portion 27*b* constituting the short side wall 27 do not extend beyond the upper flange 54 of the long side wall 51. Accordingly, if a plate material is placed on a folding container assembled in a box form and a folding container, a box container, or the like is further placed on the plate material, the plate material can be placed on the upper flange 54 of the long side wall 51 without abutting against the projections 44, 65. Further, when a folding container, a box container, or the like is stacked directly on a different folding container assembled in a box form, the folding container, box container, or the like can be horizontally and stably stacked on the upper flange 54 of the long side wall 51 because the above described projections 44, 65 do not protrude from the upper flange 54 of the long side wall 51.

Further, the projection 65 is formed in the central portion of the upper end of the long side wall 51, which portion least affects the dimensional accuracy of the folding container, thereby minimizing the unsteadiness of folding containers each assembled in a box form when they are stacked together. Therefore, folding containers each assembled in a box form can be more stably stacked together.

Figure 23:
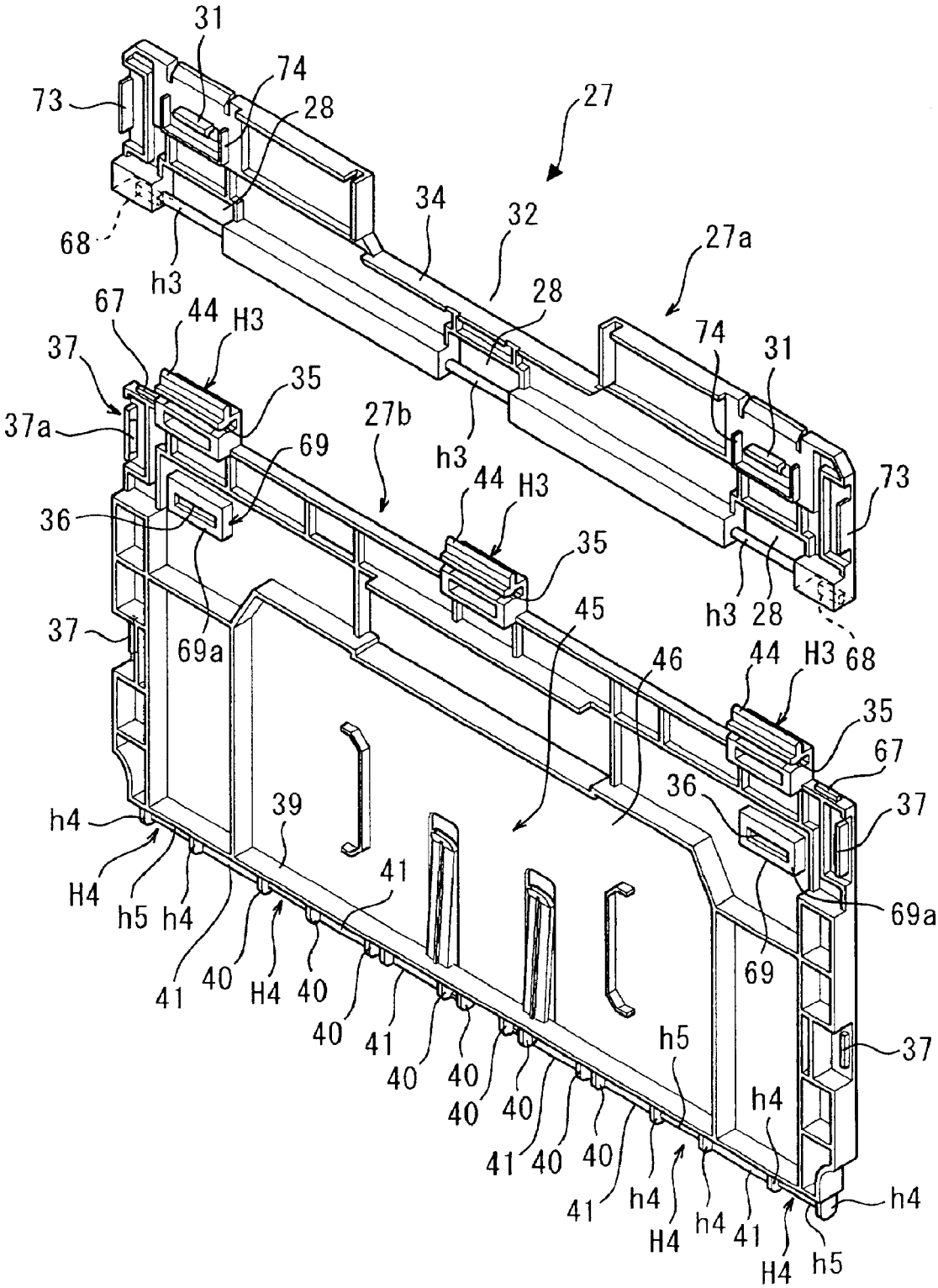
FIG. 23 is an exploded perspective view of a short side wall of another embodiment of a folding container according to the present invention.
Figure 24:
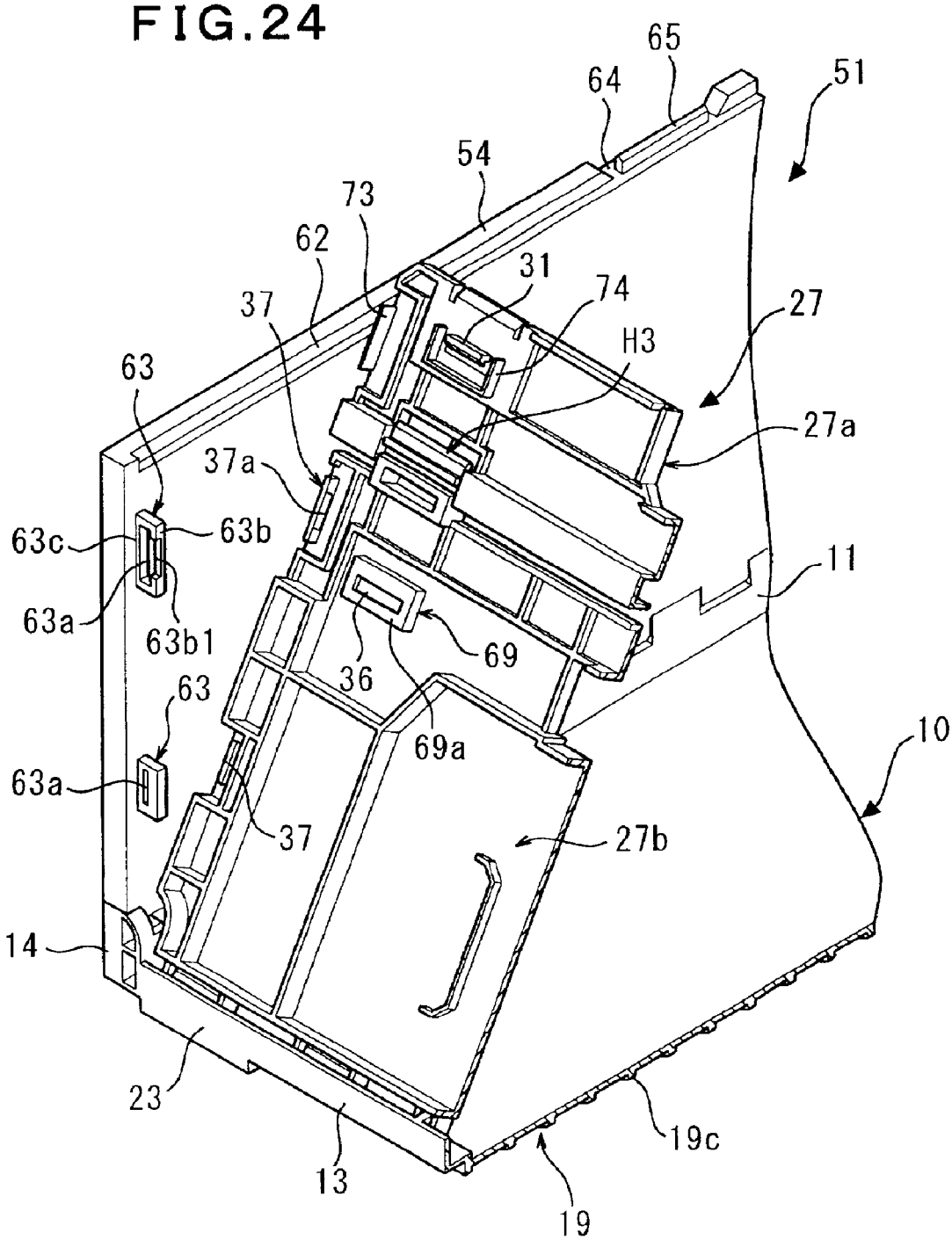
FIG. 24 is a partially enlarged perspective view of the folding container of the embodiment shown in FIG. 23, which is being folded or assembled.
Figure 25:
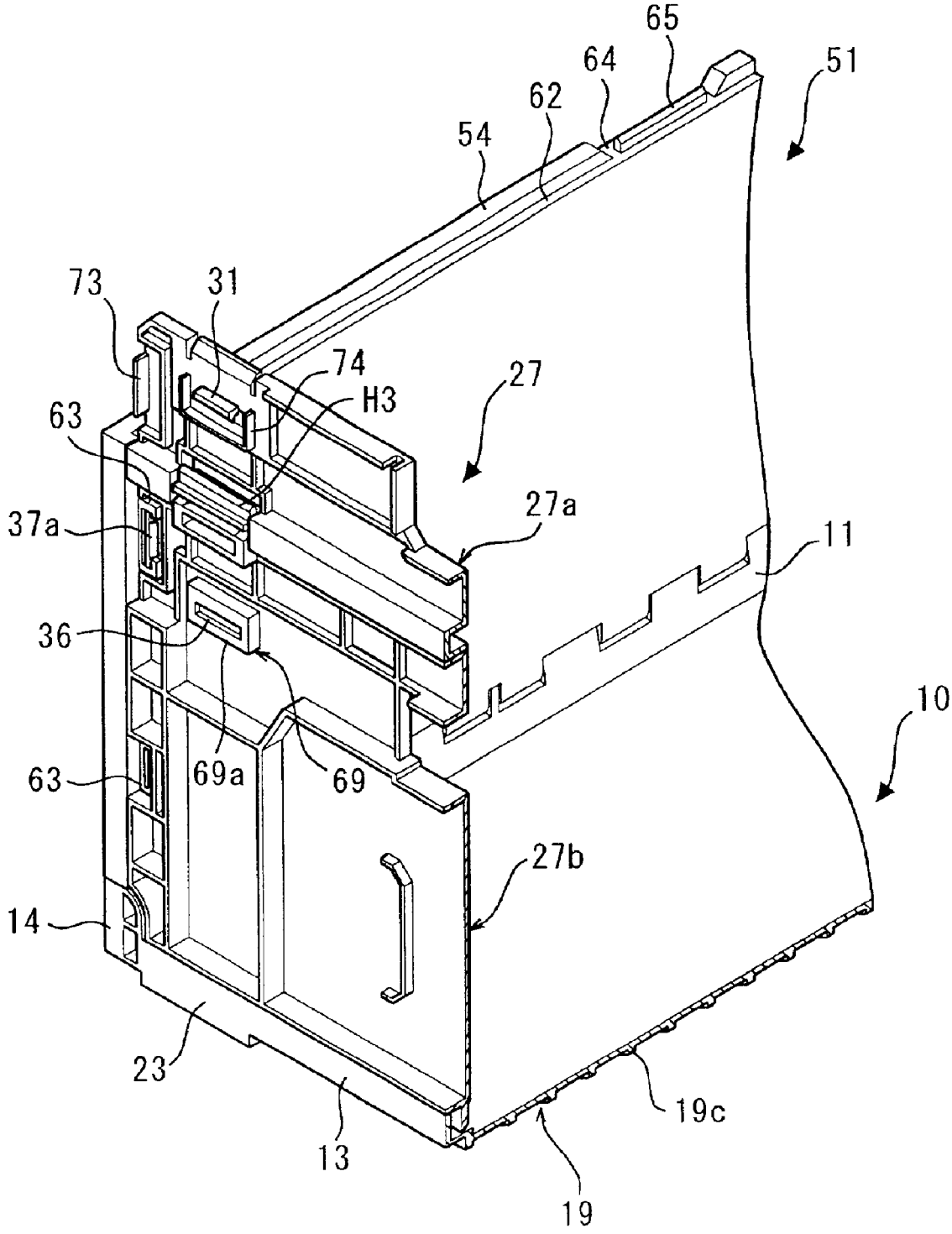
FIG. 25 is a partially enlarged perspective view of the folding container of the embodiment shown in FIG. 23, which is being folded or assembled.

Now, another embodiment of the present invention will be described with reference to FIGS. 23 to 25.

When the folding container folded as shown in FIG. 12 is to be assembled in a box form as shown in FIG. 9, first, the long side walls 51 are raised to stand substantially perpendicular to the bottom portion 10, as shown in FIG. 11, and then, the upper short side wall portion 27*a* and the lower short side wall portion 27*b* constituting each short side wall 27 which are now deployed are rotationally moved in the perpendicular direction. In the above described embodiment, during this rotational movement operation, the fitting protruding pieces 37 formed close to each of the opposite perpendicular edges of the lower short side wall portion 27*b* are simply inserted into the corresponding through-slots 63*a* drilled in the fitting pieces 63 protrusively formed close to each of the opposite edges of the inner wall surface 51*a* of the long side wall 51. However, in this embodiment, a hook portion 37*a* extending to the central portion of the lower short side wall portion 27*b*, that is, to the hand-held opening 33 is provided at the tip of each fitting protruding piece 37 so that when the fitting protruding pieces 37 are inserted into the corresponding through-slots 63*a* drilled in the fitting pieces 63, each of the hook portions 37*a* is fitted in a recess portion 63*b*1 formed in an outer frame 63*b* of the corresponding fitting piece 63 and is also engagingly locked in the outer frame 63*b* of the fitting piece 63. In this manner, the fitting protruding pieces 37 formed on the lower short side wall portion 27*b* are inserted into the corresponding through-slots 63*a* drilled in the fitting pieces 63 protrusively formed on the long side wall 51, and the hook portions 37*a* formed on the fitting protruding pieces 37 are engagingly locked in the corresponding outer frames 63*b* of the fitting pieces 63. Consequently, the lower short side wall portion 27*b* is reliably engagingly locked on the long side wall 51 to prevent the lower short side wall portion 27*b* from falling down to the bottom portion 10, thereby improving the efficiency of the operation of assembling the folding container.

Further, in this embodiment, an inserting protruding piece 73 is formed close to each of the opposite perpendicular edges of the upper short side wall portion 27*a*, and extends in the same direction as the fitting protruding piece 37 when the lower short side wall portion 27*b* and the upper short side wall portion 27*a* are deployed. As described above, the fitting protruding pieces 37 formed on the lower short side wall portion 27*b* are inserted into the corresponding through-slots 63*a* drilled in the fitting pieces 63 protrusively formed on the long side wall 51, and the hook portions 37*a* formed on the fitting protruding pieces 37 are engagingly locked in the corresponding outer frames 63*b* of the fitting pieces 63. Then, the upper short side wall portion 27*a* is rotationally moved outwardly around the hinge portion composed of the hinge female blocks H3 and the horizontal pins h3. During the rotational movement of the upper short side wall portion 27*a*, the inserting protruding pieces 73 each formed close to the corresponding one of the opposite perpendicular edges of the upper short side wall portion 27*a* are each inserted into the clearance between the corresponding inner frame 63*c* of the fitting piece 63 protrusively formed on the long side wall 51 and the corresponding fitting protruding piece 37 formed on the lower short side wall portion 27*b* and which has been inserted into the corresponding through-slot 63*a* drilled in the fitting piece 63. Then, the fitting protruding pieces 37 are pushed to the corresponding outer frames 63*b* of the fitting pieces 63 to reliably engagingly lock the hook portions 37*a* formed on the fitting protruding pieces 37 in the corresponding outer frames 63*b* of the fitting pieces 63. Subsequently, the engagingly-locking protruding pieces 31 protrusively formed on the tongue portions 29 formed close to each of the opposite ends of the upper short side wall portion 27*a* are fitted in the corresponding laterally long fitting slots 36 formed under the hinge female blocks H3 of the lower short side wall portion 27*b*. Thus, as shown in FIGS. 9 and 15, the upper short side wall portion 27*a* is placed on the lower short side wall portion 27*b* to assemble the folding container in a box form. As described above, the inserting protruding piece 73 formed closed to each of the opposite perpendicular edges of the upper short side wall portion 27*a* pushes the corresponding fitting protruding piece 37 to the outer frame 63*b* of the fitting piece 63 to reliably engagingly lock the hook portions 37*a* formed on the fitting protruding pieces 37 in the corresponding outer frames 63*b* of the fitting pieces 63. Consequently, the long side wall 51 is reliably engaged with the short side wall 27 composed of the upper short side wall portion 27*a* and the lower short side wall portion 27*b*, thereby preventing a trouble such as the disengagement of the short side wall 27 from the long side wall 51.

Furthermore, a generally U-shaped protruding portion 74 is protrusively formed around each of the engagingly-locking protruding pieces 31 formed on the upper short side wall portion 27*a*, that is, the generally U-shaped protruding portion 74 is formed under the engagingly-locking protruding piece 31 and along the opposite sides thereof. When the upper short side wall portion 27*a* is placed on the lower short side wall portion 27*b*, the generally U-shaped protruding portion 74 is located in proximity to the corresponding box-shaped projecting portion 69 being formed on the outer wall surface of the lower short side wall portion 27*b*, as shown in FIGS. 9 and 15. With this construction, when the folding container is assembled in a box form, the horizontal and downward movements of the upper short side wall portion 27*a* with respect to the lower short side wall portion 27*b* are restrained to prevent the upper short side wall portion 27*a* from rattling. Further, when a downward or sideward load is exerted on the short side wall 27 composed of the upper short side wall portion 27*a* and the lower short side wall portion 27*b*, this load can be shared by the box-shaped projecting portions 69 formed on the lower short side wall portion 27*b* and the generally U-shaped protruding portions 74 formed on the upper short side wall portion 27*a* arranged in proximity to the box-shaped projecting portions 69, thereby preventing the engagingly-locking protruding pieces 31 formed on the upper short side wall portion 27*a* from being damaged.

Figure 26:
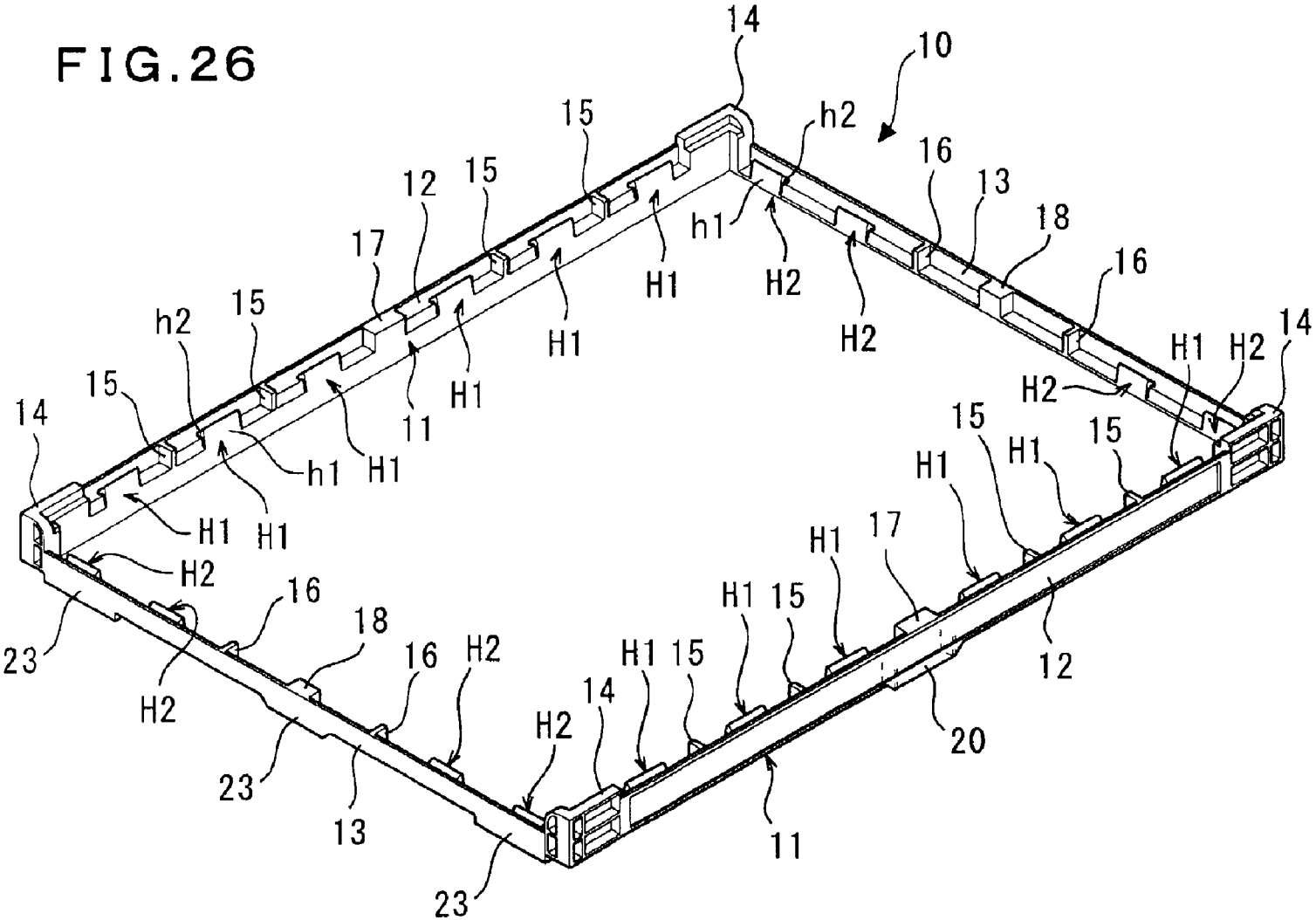
FIG. 26 is a perspective view of a bottom portion of further another embodiment of a folding container according to the present invention.
Figure 27:
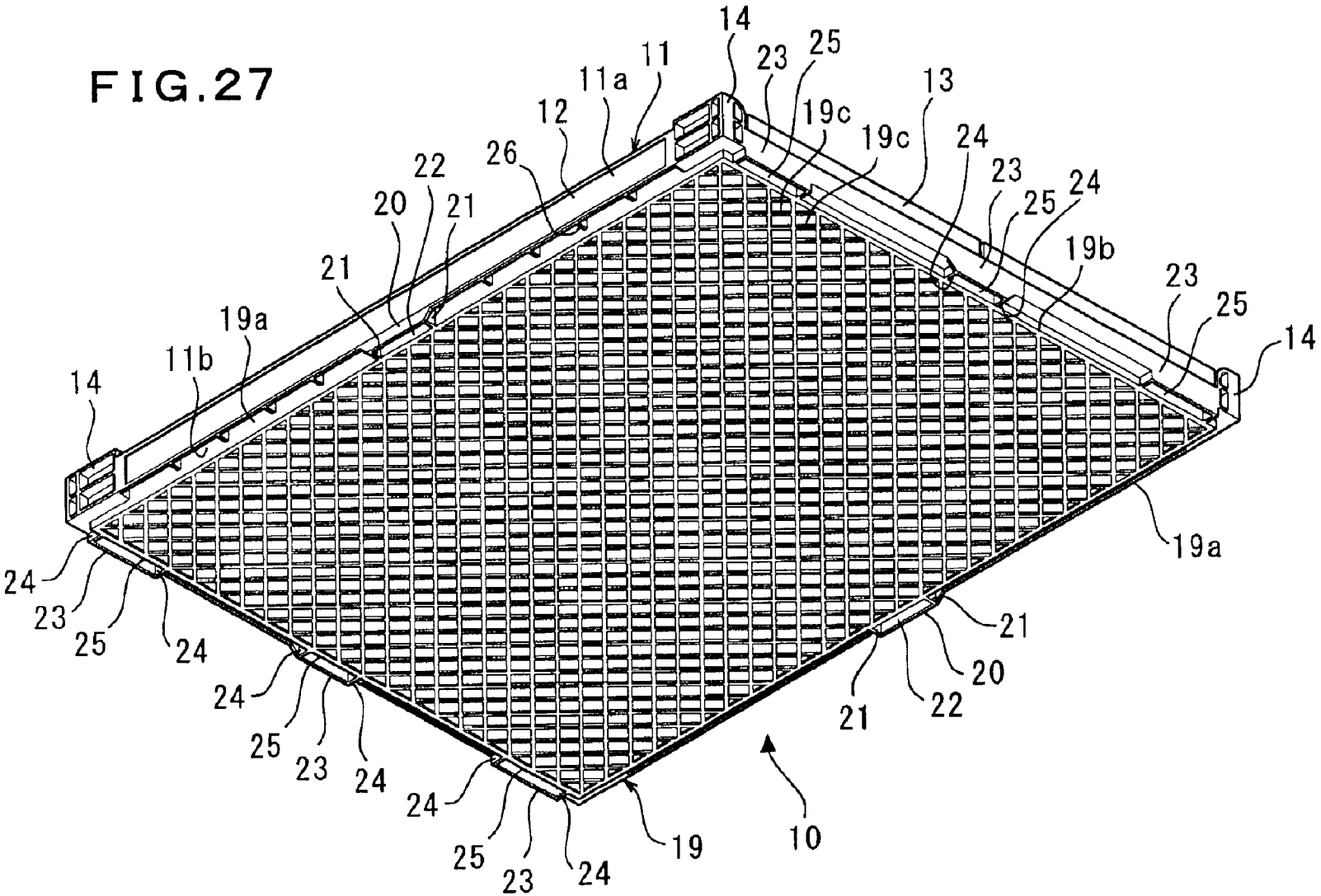
FIG. 27 is a perspective view of the bottom portion shown in FIG. 26 as viewed from a back surface thereof.
Figure 28:
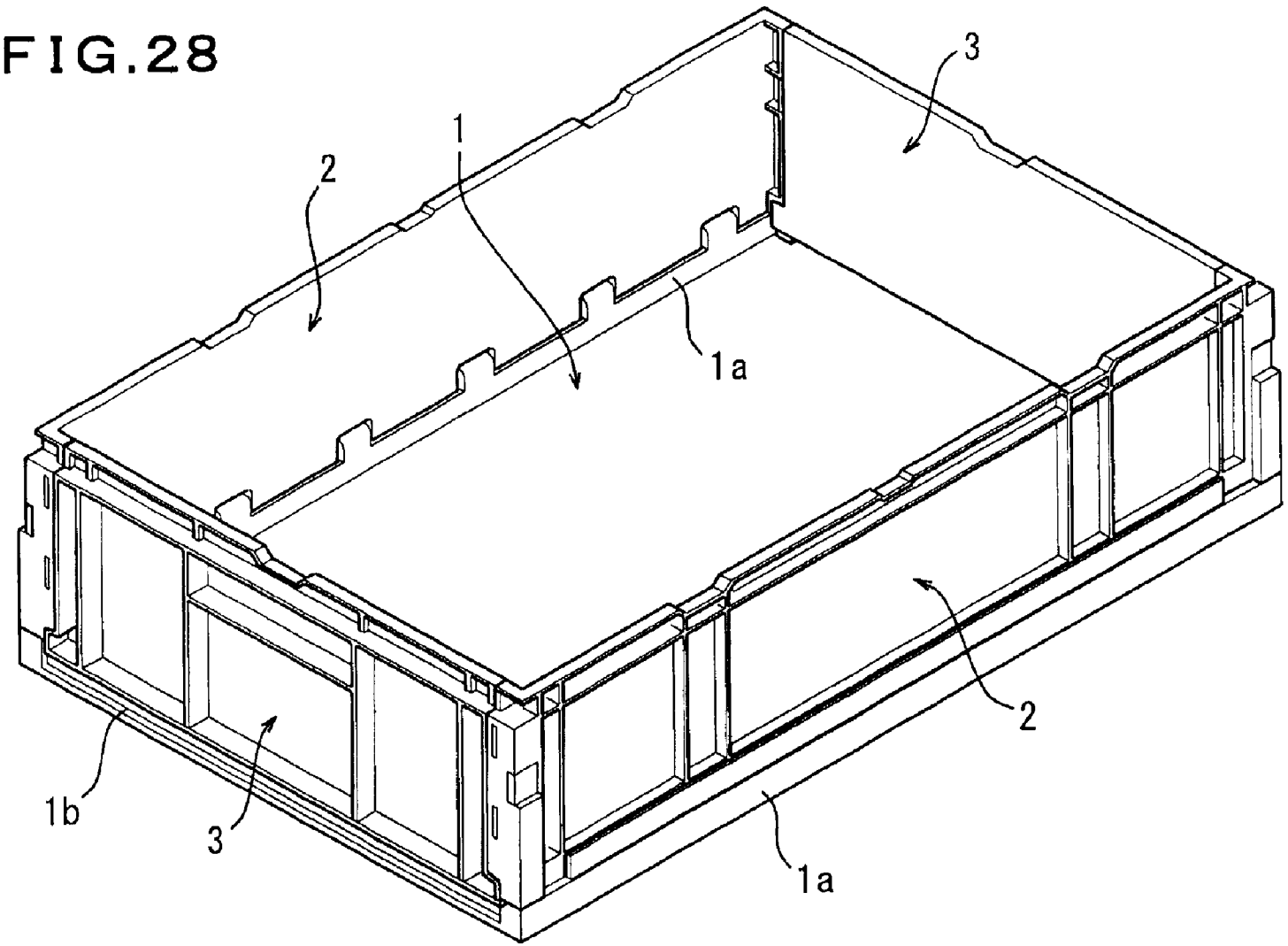
FIG. 28 is a perspective view of a conventional folding container assembled in a box form.
Figure 29:
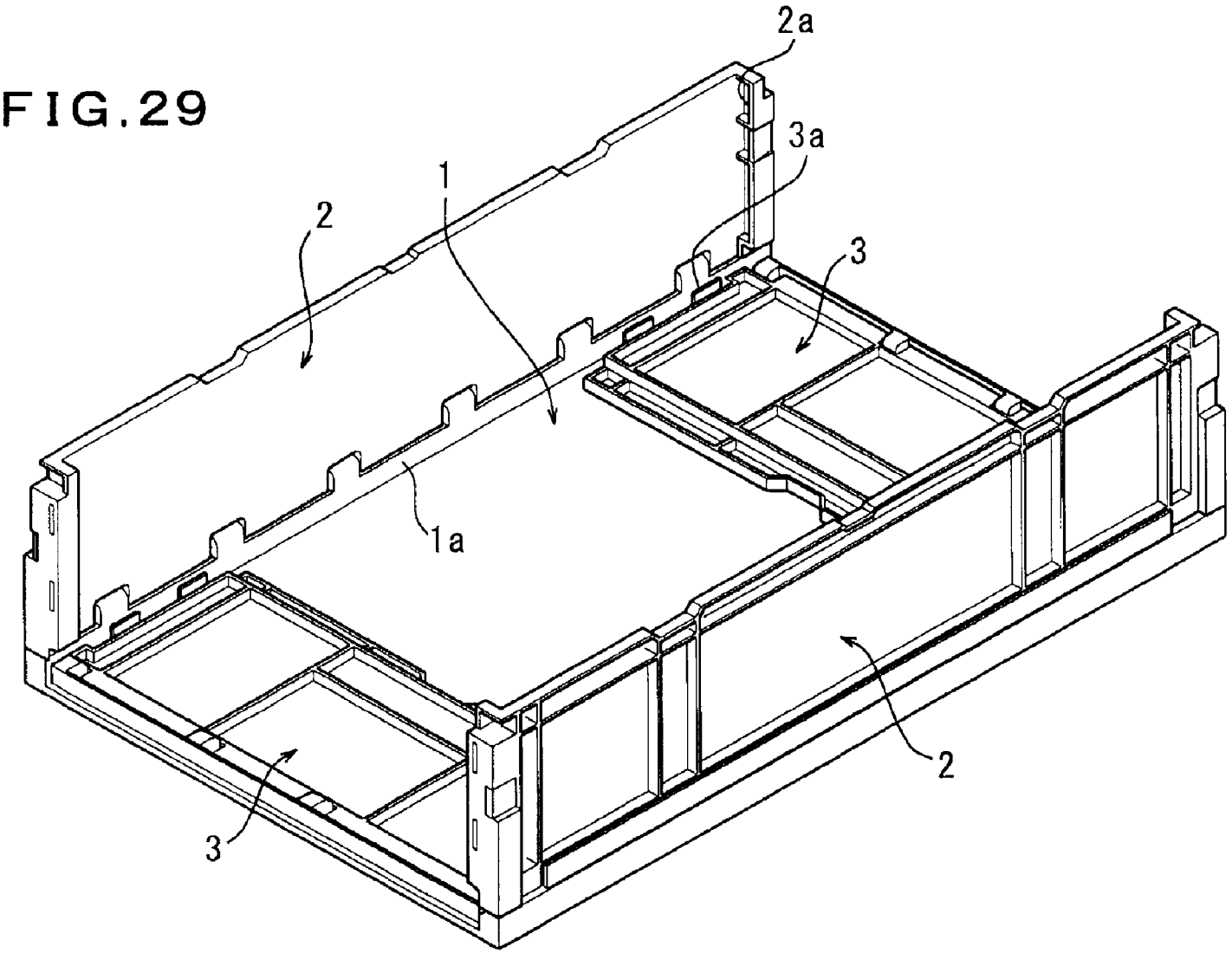
FIG. 29 is a perspective view of the conventional folding container, which is being folded or assembled.
Figure 30:
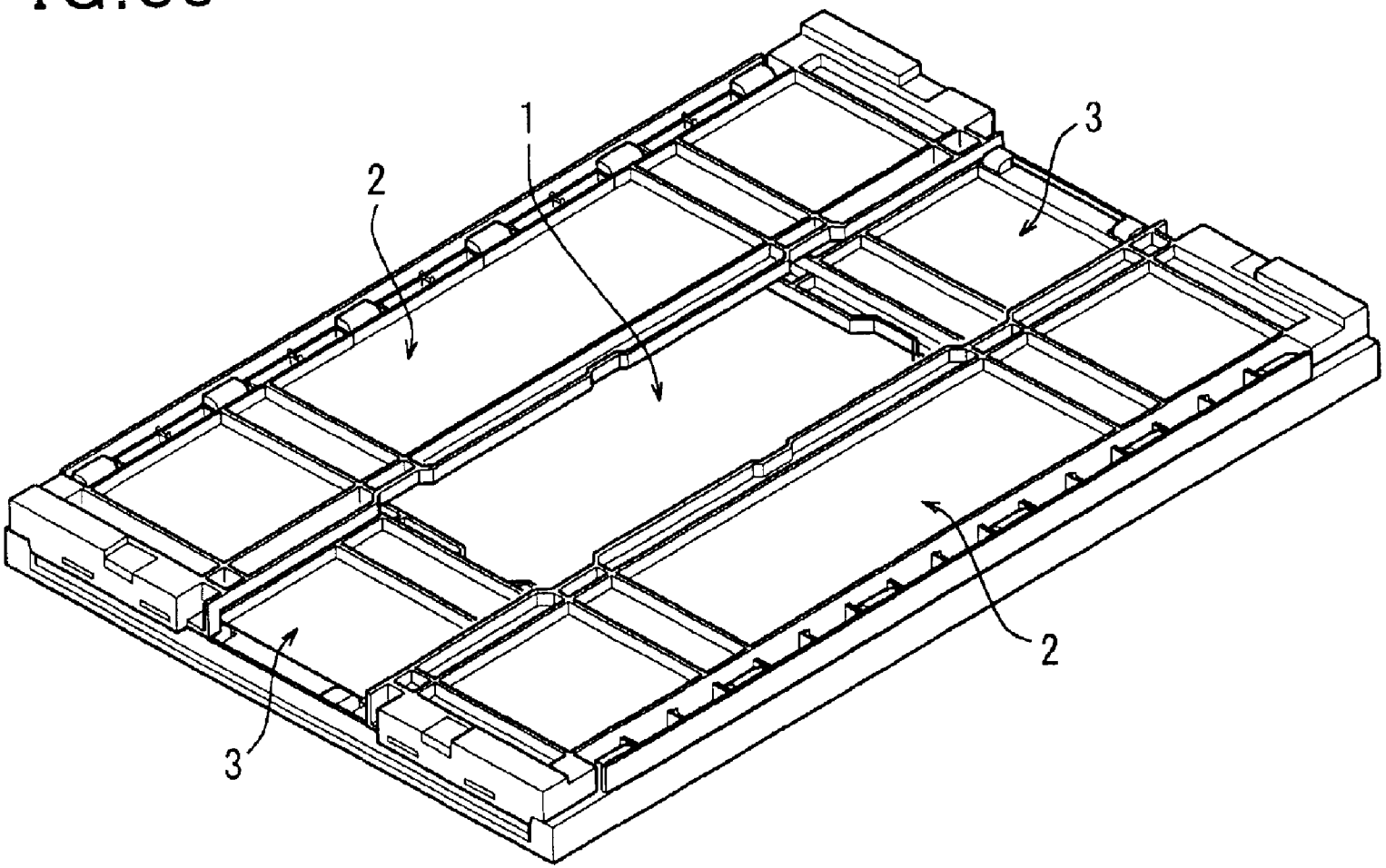
FIG. 30 is a perspective view of the folded conventional folding container.

Next, further another embodiment will be described with reference to FIGS. 26 and 27.

Figure 2:
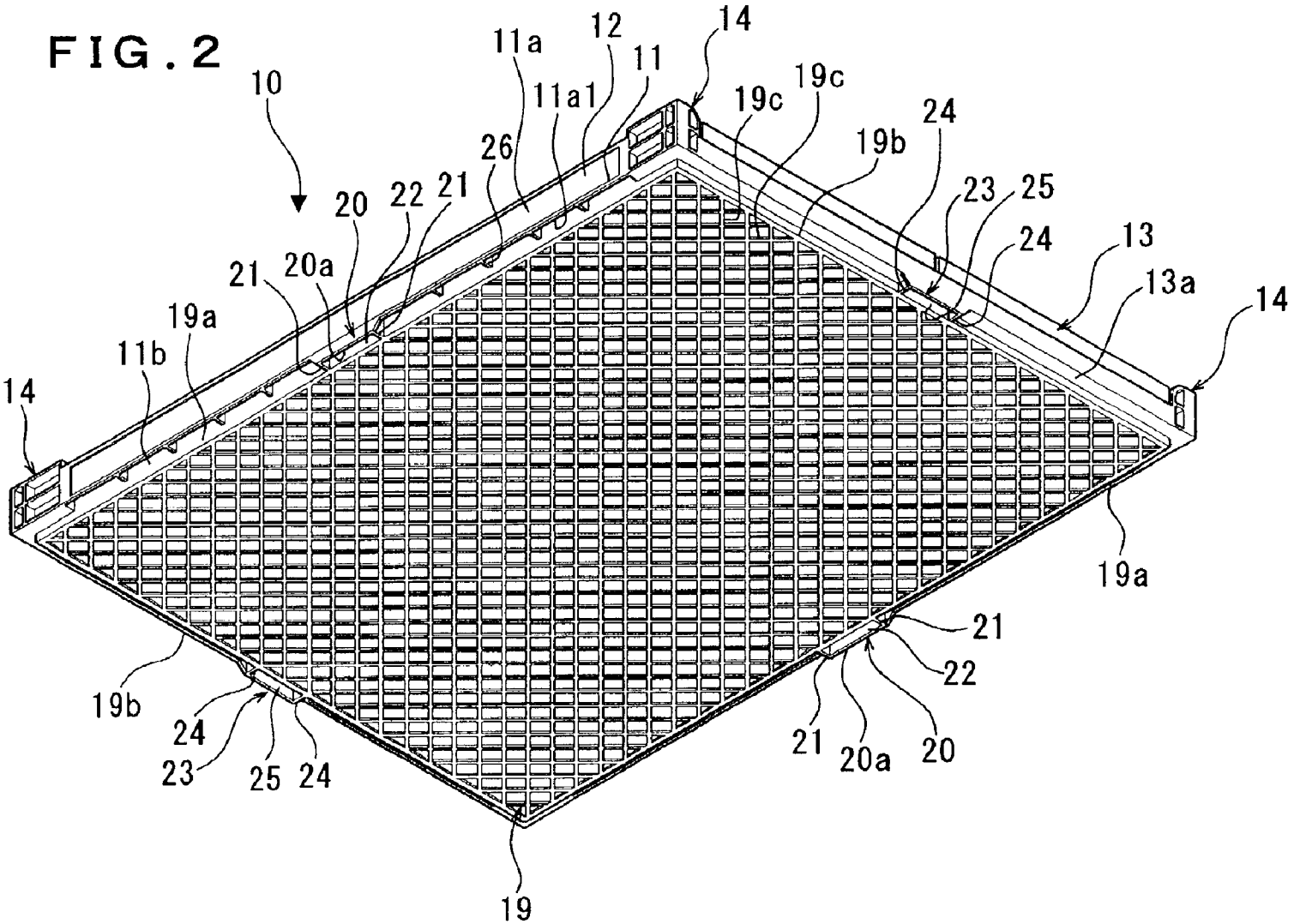
FIG. 2 is a perspective view of the bottom portion shown in FIG. 1 as viewed from a back surface thereof.
Figure 3:
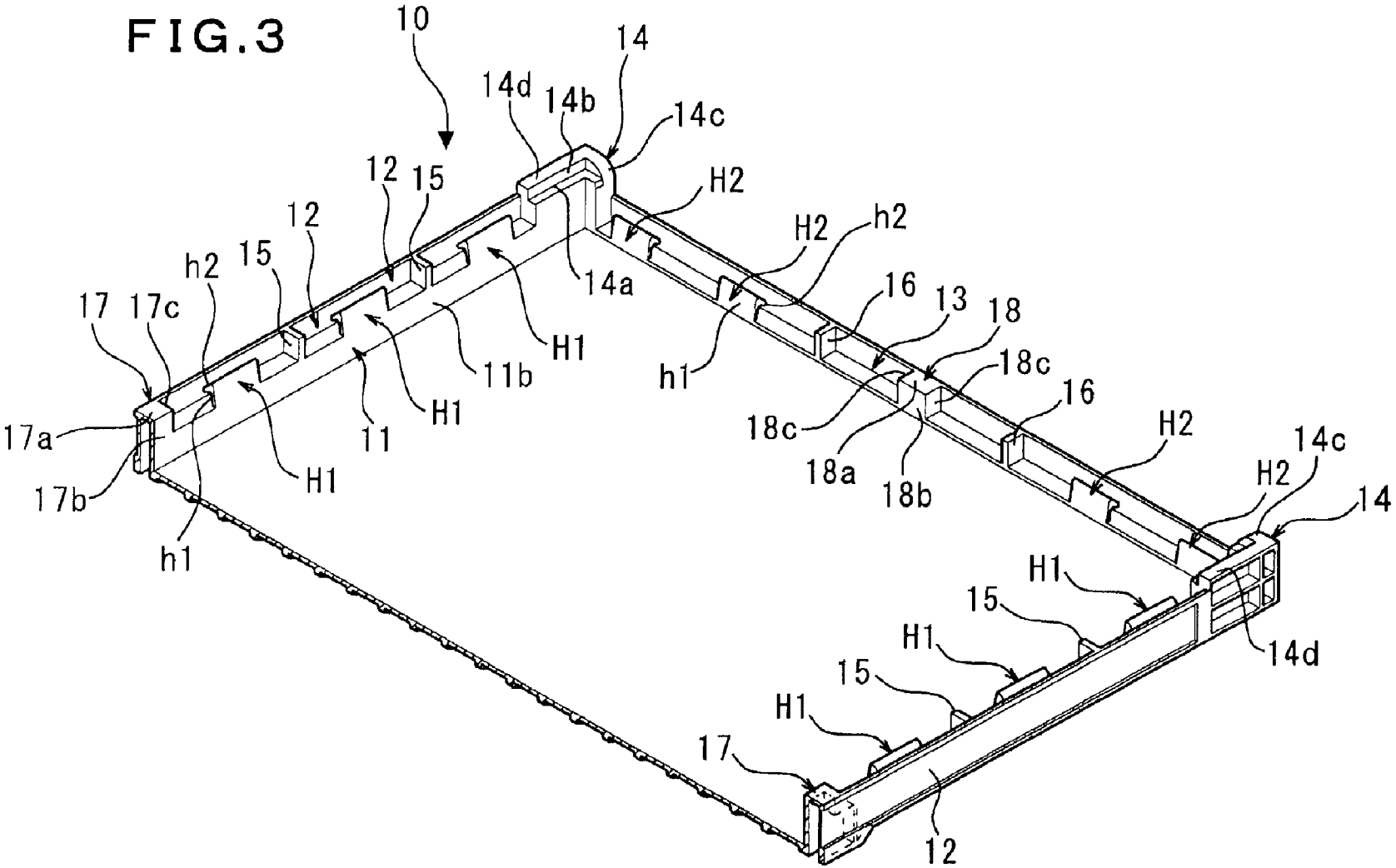
FIG. 3 is a partially enlarged perspective view of the bottom portion shown in FIG. 1.
Figure 4:
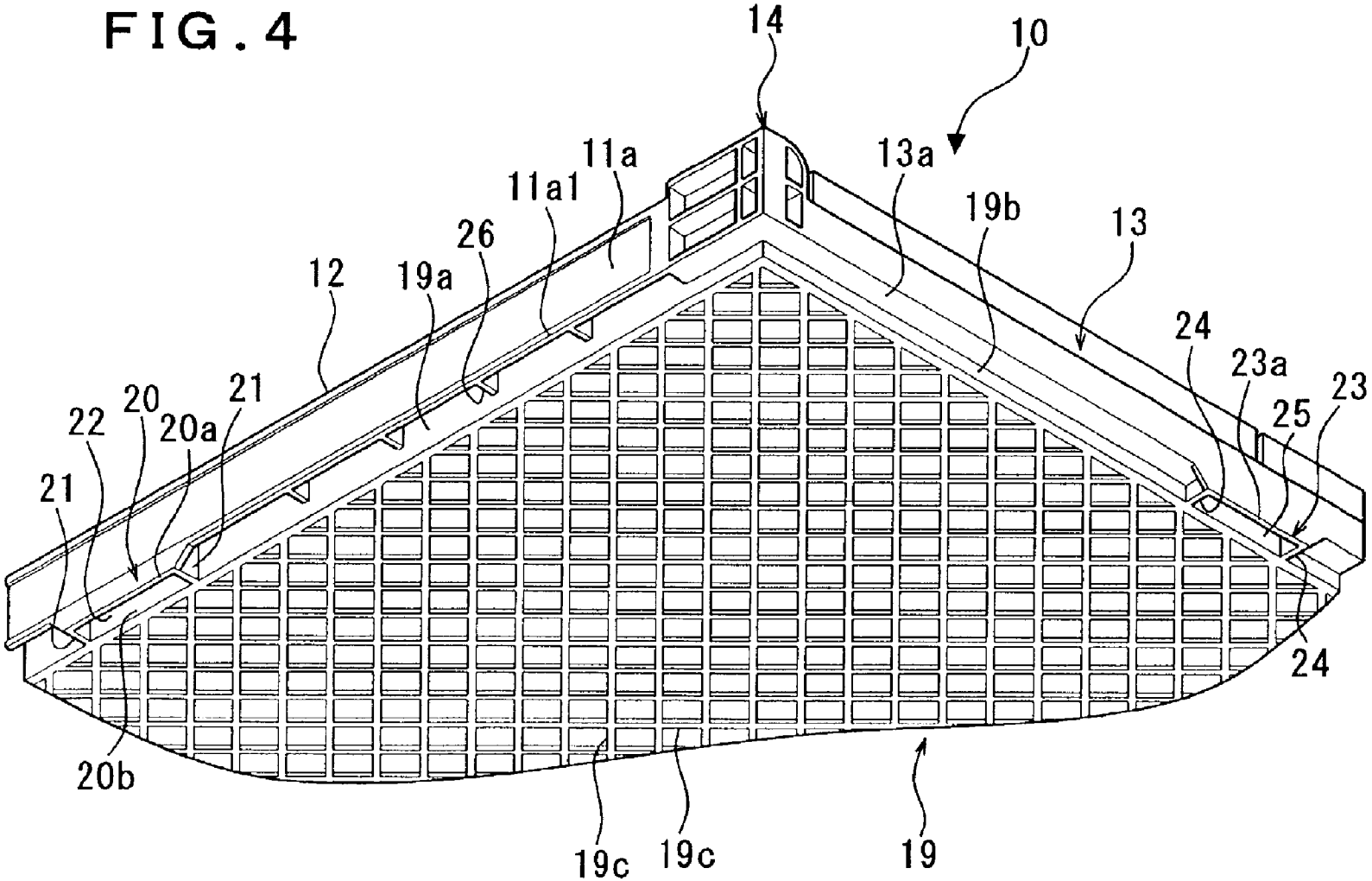
FIG. 4 is a partially enlarged perspective view of the bottom portion shown in FIG. 2.

In the above described embodiments, as shown in FIGS. 1, 2 and 4, the short-side outer walls 13 of the bottom portion 10 each have the protruding wall 23 in the substantially central portion thereof, and the protruding wall 23, the short-side side wall 19*b* of the fitting portion 19 and the pair of partitioning walls 24 form each short-side fitting recess portion 25 that is open at its bottom. Then, when the folding container C1 assembled in a box form and located above is stacked on the folding container C2 assembled in a box form and located below as shown in FIG. 18, the projection 44 protrusively formed on the top surface of the hinge female block H3 formed in the central portion of the upper end of the lower short side wall portion 27*b* of the folding container C2 located below is inserted into the short-side fitting recess portion 25 formed in the substantially central portion of the short-side outer wall 13 of the bottom portion 10 of the folding container C1 located above. This construction prevents the folding container C1 assembled in a box form and located above from moving along the short side walls 27 of the folding container C2 assembled in a box form and located below, and also prevents the short side walls 27 of the folding container C2 assembled in a box form and located below from being bulged outward owing internal pressure exerted by articles in the container or the weight of the folding container C1 assembled in a box form and located above. However, if for example, the short side walls 27 of the folding container C2 assembled in a box form and located below are bent outward owing internal pressure exerted by articles in the container, a trouble may occur such that the projection 44 protrusively formed on the top surface of the hinge female block H3 of the folding container C2 located below is not inserted into the corresponding short-side fitting recess portion 25 formed in the substantially central portion of the short-side outer wall 13 of the bottom portion 10 of the folding container C1 located above.

In this embodiment, to solve this problem, the short-side outer wall 13 of the bottom portion 10 also has the protruding wall 23 formed at each of the opposite ends thereof, and the protruding wall 23, the short-side side wall 19*b* of the fitting portion 19 and the pair of partitioning walls 24 form each short-side fitting recess portion 25 that is open at its bottom. Then, when the folding container C1 assembled in a box form and located above is stacked on the folding container C2 assembled in a box form and located below, the projection 44 protrusively formed on the top surface of the hinge female block H3 formed in the central portion of the upper end of the lower short side wall portion 27*b* of the folding container C2 located below is inserted into the short-side fitting recess portion 25 formed in the substantially central portion of the short-side outer wall 13 of the bottom portion 10 of the folding container C1 located above. Further, the projections 44 protrusively formed on the top surfaces of the hinge female blocks H3 each formed close to the corresponding one of the opposite ends of the lower short side wall portion 27*b* of the folding container C2 located below are inserted into the corresponding short-side fitting recess portions 25 each formed close to the corresponding one of the opposite ends of the short-side outer wall 13 of the bottom portion 10 of the folding container C1 located above.

As described above, the three projections 44 protrusively formed on the top surfaces of the respective hinge female blocks H3 one of which is formed in the central portion of the upper end of the lower short side wall portion 27*b* and the remaining two of which are formed close to the opposite ends of the lower short side wall portion 27*b* of the folding container C2 located below are inserted into the corresponding short-side fitting recess portions 25 one of which is formed in the substantially central portion of the short-side outer wall 13 of the bottom portion 10 and the remaining two of which are formed close to the opposite ends of the short-side outer wall 13 of the folding container C1 located above. This construction reliably prevents the short side walls 27 of the folding container C2 assembled in a box form and located below from being bulged outward.

Further, even if the short side wall 27 of the folding container C2 assembled in a box form and located below is bent outward, the short side wall 27 is less sharply bent at the opposite ends thereof than in the central portion thereof. Accordingly, even if the projection 44 protrusively formed on the top surface of the hinge female block H3 formed in the central portion of the upper end of the lower short side wall portion 27*b* of the folding container C2 assembled in a box form and located below is not inserted into the corresponding short-side fitting recess portion 25 formed in the substantially central portion of the short-side outer wall 13 of the bottom portion 10 of the folding container C1 assembled in a box form and located above, the two projections 44 protrusively formed on the top surfaces of the two hinge female blocks H3 each formed close to the corresponding one of the opposite ends of the lower short side wall portion 27*b* of the folding container C2 assembled in a box form and located below are inserted into the corresponding two short-side fitting recess portions 25 each formed close to the corresponding one of the opposite ends of the short-side outer wall 13 of the bottom portion of the folding container C1 assembled in a box form and located above. This prevents the short side walls 27 of the folding container C2 assembled in a box form and located below from being bulged outward, while preventing the folding container C1 assembled in a box form and located above from moving along the short side walls 27 of the folding container C2 assembled in a box form and located below.

Furthermore, using the protruding wall 23, the short-side side wall 19*b* of the fitting portion 19 and the pair of partitioning walls 24, the short-side fitting recess portion 25 that is open at its bottom is also formed close to each of the opposite ends of the short-side outer wall 13 of the bottom portion 10, thereby improving the rigidity and compression strength of the bottom portion 10 and thus the rigidity and compression strength of the folding containers. Consequently, more folding containers can be stably stacked together.

In the above described embodiments, the protruding wall 20 is formed in the substantially central portion of the outer wall 11*a* constituting each long-side shoulder portion 11 of the bottom portion 10, and the protruding wall 20, the long-side side wall 19*a* of the fitting portion 19 and the pair of partitioning walls 21 form each long-side fitting recess portion 22 that is open at its bottom. However, the three long-side fitting recess portions 22 can be formed by forming the protruding wall 20 and the pair of partitioning walls 21 close to each of the opposite ends of the outer wall 11*a* constituting each long-side shoulder portion 11 of the bottom portion 10. If the long-side fitting recess portion 22 is thus formed close to each of the opposite ends of the outer wall 11*a*, the above described recess section 64 is formed at each of the opposite ends of the upper end of the long side wall 51 correspondingly to long-side fitting recess portion 22 formed close to each of the opposite ends, and the projection 65 is protrusively formed on the bottom surface 64*a* of each recess portion 64. With this construction, even if the long side wall 51 of the folding container C2 assembled in a box form and located below is bent outward, the long side wall 51 is less sharply bent at the opposite ends thereof than in the central portion thereof. Accordingly, even if the projection 65 protrusively formed in the central portion of the upper end of the long side wall 51 of the folding container C2 assembled in a box form and located below is not inserted into the corresponding long-side fitting recess portion 22 formed in the substantially central portion of the long-side shoulder portion 11 of the bottom portion 10 of the folding container C1 assembled in a box form and located above, the two projections 22 each protrusively formed close to the corresponding one of the opposite ends of the upper end of the long side wall 51 of the folding container C2 assembled in a box form and located below are inserted into the corresponding two long-side fitting recess portions 22 each formed close to the corresponding one of the opposite ends of the long-side shoulder portion 11 of the bottom portion of the folding container C1 assembled in a box form and located above. This prevents the long side walls 51 of the folding container C2 assembled in a box form and located below from being bulged outward, while preventing the folding container C1 assembled in a box form and located above from moving along the long side walls 51 of the folding container C2 assembled in a box form and located below.

In the above described embodiments, when the folding container is assembled in a box form, the upper short side wall portion 27*a* constituting the short side wall 27 overlaps substantially upper one-third of the lower short side wall portion 27*b*, but the upper short side wall portion 27*a* may overlap substantially half the lower short side wall portion 27*b* when the folding container is assembled in a box form unless the tips of both upper short side wall portions 27*a* overlap each other when the upper short side wall portion 27*a* and the lower short side wall portion 27*b* are deployed rather than overlapping each other, as shown in FIG. 11.

With the above described construction, the present invention has the following effects:

The short side walls are each composed of the upper short side wall portion and the lower short side wall portion connected together with the hinge members to reduce the height of the folding container when it is folded. Accordingly, the folded folding container can be more efficiently housed to save housing spaces.

The upper short side wall portion placed on the lower short side wall portion are locked on the lower short side wall portion by the lock means, thereby preventing the upper short side wall portion from being unsteady.

The long side wall and the short side wall are engaged with each other by inserting the fitting protruding pieces formed on the lower short side wall portion, in the corresponding through-slots in the fitting pieces formed on the long side wall. Consequently, the long side wall and the short side wall can be easily and quickly engaged with and disengaged from each other, thereby improving the efficiency of the operations of assembling and folding the folding container.

The inserting protruding piece is formed close to the corresponding one of the opposite perpendicular edges of the upper short side wall portion, and is inserted into the clearance formed between the corresponding inner frame of the fitting piece protrusively formed on the long side wall and the corresponding fitting protruding piece formed on the lower short side wall portion and which has been inserted into the corresponding through-slot drilled in the fitting piece. Accordingly, the hook portion formed on the fitting protruding piece is reliably engagingly locked on the fitting piece.

The upper short side wall portion and the lower short side wall portion constituting the short side wall are placed on the bottom portion so as to be flush with each other, thus reducing the height of the folding container when it is folded. Consequently, the folded folding container can be more efficiently housed to save the housing space.

The upper short side wall portion is prevented from rotationally moving inwardly of the folding container from its perpendicular state, thereby preventing the lower short side wall portion and the upper short side wall portion from being rotationally moved toward the bottom portion while both the lower short side wall portion and the upper short side wall portion are inclined in an inversely V-shaped form or while the upper short side wall portion overlaps the lower short side wall portion inside the folding container. This improves the efficiency of the operation of folding the folding container.

The projections formed on the long side wall of the folding container assembled in a box form and located below are inserted into the corresponding long-side fitting recess portions formed on the long side of the bottom portion of the folding container assembled in a box form and located above. As a result, when folding containers each assembled in a box form are stacked together, the long side walls of the folding container located below are prevented from being bulged outward owing to the weight of the folding container located above.

The projections protrusively formed on the hinge female blocks formed on the lower short side wall portion of the folding container assembled in a box form and located below are inserted into the corresponding short-side fitting recess portions formed in the short side of the bottom portion of the folding container assembled in a box form and located above. Consequently, when folding containers each assembled in a box form are stacked together, the short side walls of the folding container located below are prevented from being bulged outward owing to the weight of the folding container located above.

What is claimed is:

1. A folding container assembled in a box form by raising folded long side walls to stand perpendicular to a bottom portion and then raising folded short side walls to stand perpendicular to the bottom portion, the folding container being characterized in that:

the short side walls are each composed of an upper short side wall portion and a lower short side wall portion which are connected together via hinge members, said upper short side wall portions and said lower short side wall portions having equal widths, and, when said upper short side wall portions are rotated to extend upward in a plane with said lower short side wall portions, said short side walls extend higher than said long side walls, wherein said upper short side wall portion is arranged for overlapping said lower short side wall portion by being folded at said hinge member when said folding container is assembled in a box form, and the upper short side wall portion overlapping the lower short side wall portion is locked on the lower short side wall portion by lock means when said folding container is assembled in a box form, said container being further characterized in that inward-fall preventing protrusions are formed at an upper end of the lower short side wall portion, and similar inward-fall preventing protrusions are formed at a lower end of the upper short side wall portion so that when the upper short side wall portions of the folding container assembled in a box form are rotationally moved substantially through 180° from a state in which the lower short side wall portion and the upper short side wall portion are placed on each other until the lower short side wall portion and the upper short side wall portion are substantially flush with each other, the inward-fall preventing protrusions formed at the lower end of said upper short side wall portion impact the corresponding inward-fall preventing protrusions protrusively formed at the upper end of the lower short side wall portion, thereby preventing said upper short side wall portion from rotatably moving inwardly of the folding container from a perpendicular state thereof.

2. A folding container assembled in a box form by raising folded long side walls to stand perpendicular to a bottom portion and then raising folded short side walls to stand perpendicular to the bottom portion, the folding container being characterized in that:

the short side wails are each composed of an upper short side wall portion and a lower short side wall portion which are connected together via hinge members, said upper short side wall portion and said lower short side wall portion having equal widths, and, when said upper short side wall portions are rotated to extend upward in a plane with said lower short side wall portions, said short side walls extend higher than said long side walls, wherein said upper short side wall portion is arranged for overlapping said lower short side wall portion by being folded at said hinge member when said folding container is assembled in a box form, and the upper short side wall portion overlapping the lower short side wall portion is locked on the lower short side wall portion by lock means when said folding container is assembled in a box form, said container being further characterized in that the lock means is composed of fitting slots formed in the lower short side wall portion and engagingly-locking protruding pieces formed on the upper short side wall portion and which are fitted in the corresponding fitting slots, and inward-fall preventing protrusions are formed at an upper end of the lower short side wall portion, and similar inward-fall preventing protrusions are formed at a lower end of the upper short side wall portion so that when the upper short side wail portions of the folding container assembled in a box form are rotationally moved substantially through 180° from a state in which the lower short side wall portion and the upper short side wall portion are placed on each other until the lower short side wall portion and the upper short side wail portion are substantially flush with each other, the inward-fall preventing protrusions formed at the lower end of said upper short side wall portion impact the corresponding inward-fall preventing protrusions protrusively formed at the upper end of the lower short side wall portion, thereby preventing said upper short side wall portion from rotatably moving inwardly of the folding container from a perpendicular state thereof.

* * * * *